US007903034B2

(12) United States Patent
Anguera et al.

(10) Patent No.: US 7,903,034 B2
(45) Date of Patent: Mar. 8, 2011

(54) ANTENNA SET, PORTABLE WIRELESS DEVICE, AND USE OF A CONDUCTIVE ELEMENT FOR TUNING THE GROUND-PLANE OF THE ANTENNA SET

(75) Inventors: Jaume Anguera, Vinaros (ES); Antonio Condes, Sta. Coloma de Cervelló (ES)

(73) Assignee: Fractus, S.A., Barcelona (ES)

( * ) Notice: Subject to any disclaimer, the term of this patent is extended or adjusted under 35 U.S.C. 154(b) by 286 days.

(21) Appl. No.: 12/066,897

(22) PCT Filed: Sep. 15, 2006

(86) PCT No.: PCT/EP2006/009019

§ 371 (c)(1),
(2), (4) Date: Apr. 22, 2008

(87) PCT Pub. No.: WO2007/039071

PCT Pub. Date: Apr. 12, 2007

(65) Prior Publication Data

US 2008/0252536 A1 Oct. 16, 2008

Related U.S. Application Data

(60) Provisional application No. 60/718,537, filed on Sep. 19, 2005.

(30) Foreign Application Priority Data

Sep. 19, 2005 (EP) ..... 05108616

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | |
|---|---|---|---|
| 4,571,595 | A | 2/1986 | Phillips et al. |
| 6,039,583 | A | 3/2000 | Korsunsky et al. |
| 6,340,952 | B1 | 1/2002 | Tsai et al. |
| 6,466,176 | B1 | 10/2002 | Maoz et al. |
| 6,480,155 | B1 | 11/2002 | Eggleston |
| 6,639,560 | B1 | 10/2003 | Kadambi et al. |
| 6,717,494 | B2 | 4/2004 | Kikuchi et al. |

(Continued)

FOREIGN PATENT DOCUMENTS

CA 2416437 A1 1/2002

(Continued)

OTHER PUBLICATIONS

Lindberg, P, ; Öjefors, E., A bandwidth enhancement technique for mobile handset antennas using wavetraps, IEEE Transactions on antennas and propagation, vol. 54, No. 8, Aug. 2006.

(Continued)

*Primary Examiner* — Hoang V Nguyen
(74) *Attorney, Agent, or Firm* — Winstead PC

(57) ABSTRACT

An antenna set comprising at least one antenna element and a ground plane, is complemented by a conductive element coupled to the ground plane, so as to modify the frequency performance of the antenna set, adding an operating band to the antenna set, and/or increasing the bandwidth of one operating band of the antenna set, and/or enhancing voltage standing wave ration, efficiency and/or gain of the antenna set. Thus, the conductive element can be used to tune the antenna set in accordance with specific requirements concerning, for example, compatibility with different wireless services.

42 Claims, 17 Drawing Sheets

U.S. PATENT DOCUMENTS

Figure 1:
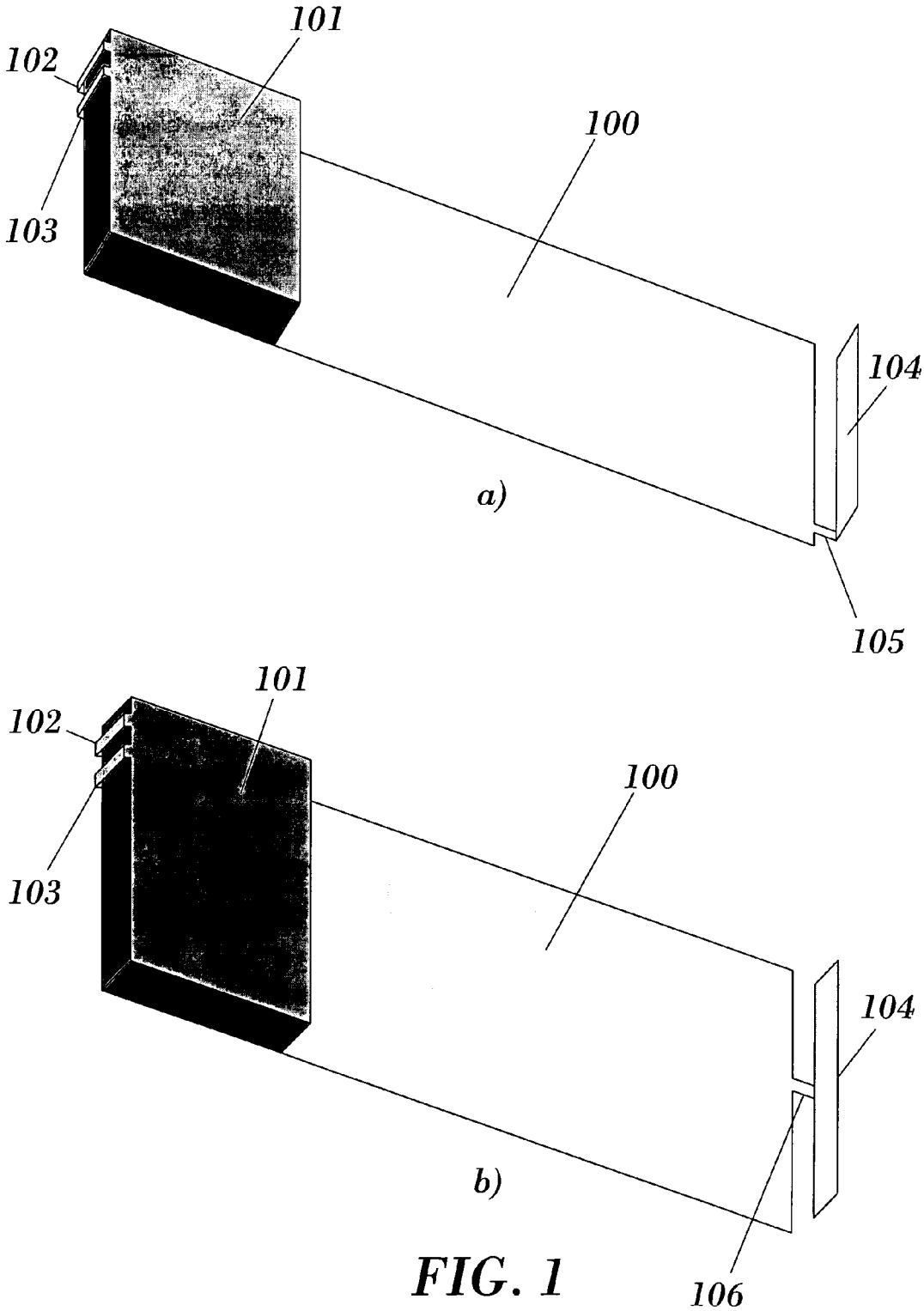
Figure 1:
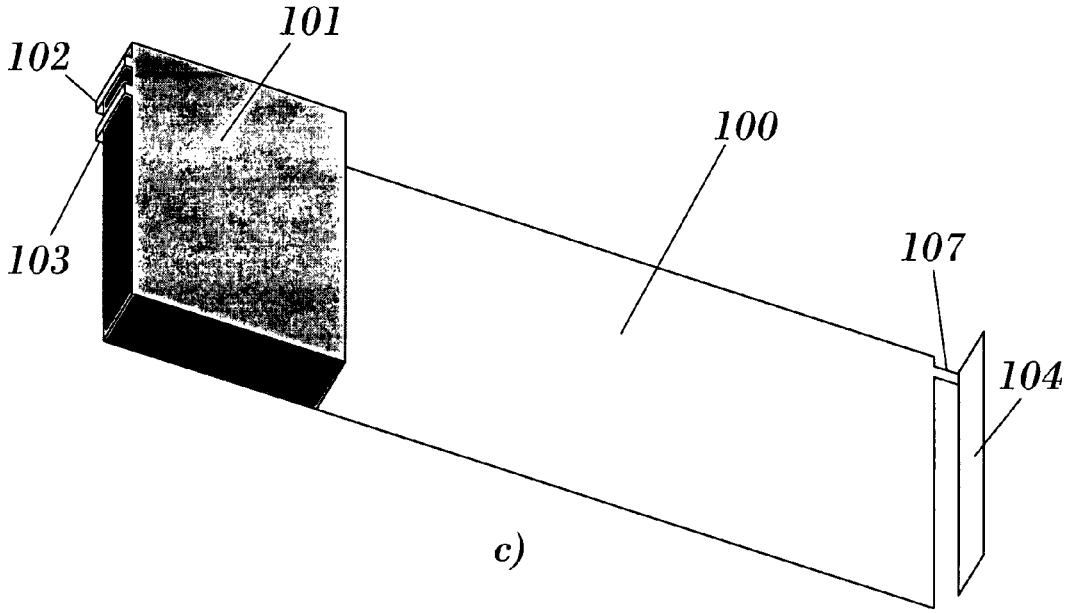

| | | | |
|---|---|---|---|
| 6,791,498 | B2 | 9/2004 | Boyle et al. |
| 6,940,460 | B2 | 9/2005 | Maoz et al. |
| 6,963,310 | B2 | 11/2005 | Horita et al. |
| 6,992,627 | B1 | 1/2006 | Honda et al. |
| 7,006,045 | B2 | 2/2006 | Takebe |
| 7,053,852 | B2 | 5/2006 | Timofeev et al. |
| 7,151,955 | B2 | 12/2006 | Huber et al. |
| 7,196,674 | B2 | 3/2007 | Timofeev et al. |
| 2003/0151557 | A1 | 8/2003 | Johnson |
| 2004/0037052 | A1 | 2/2004 | Wu et al. |
| 2007/0159401 | A1 | 7/2007 | Baliarda et al. |

FOREIGN PATENT DOCUMENTS

| | | | |
|---|---|---|---|
| DE | 10204877 | | 8/2003 |
| DE | 10248756 | | 3/2004 |
| EP | 1085597 | A2 | 3/2001 |
| EP | 1172884 | | 1/2002 |
| EP | 1172884 | A2 | 1/2002 |
| EP | 1396906 | A1 | 3/2004 |
| EP | 1403960 | A1 | 3/2004 |
| EP | 1447879 | A1 | 8/2004 |
| JP | 2002510886 | | 4/2002 |
| WO | 0126181 | A1 | 4/2001 |
| WO | 0180354 | A1 | 10/2001 |
| WO | 0213306 | A1 | 2/2002 |
| WO | 0237603 | A1 | 5/2002 |
| WO | 03026064 | A1 | 3/2003 |
| WO | WO-03/023900 | | 3/2003 |
| WO | 03069729 | A1 | 8/2003 |
| WO | 2005107008 | A1 | 11/2005 |
| WO | 2006032455 | A1 | 3/2006 |

OTHER PUBLICATIONS

Rubin, B.J.; Singh, B., Study of meander line delay in circuit boards, IEEE Transactions on microwave theory and techniques, vol. 48, No. 9, Sep. 2000.

Shum, K.M.; Chan, C.H.; Luk, K.M., Design of small antennas for joypad applications, IWAT, Mar. 2006.

b)

c)

a)

b)

ANTENNA SET, PORTABLE WIRELESS DEVICE, AND USE OF A CONDUCTIVE ELEMENT FOR TUNING THE GROUND-PLANE OF THE ANTENNA SET

CROSS-REFERENCE TO RELATED APPLICATIONS

This application claims priority from and incorporates by reference the entire disclosure of U.S. Provisional Patent Application No. 60/718,537, which was filed on Sept. 19, 2005.

OBJECT OF THE INVENTION

The present invention relates to an antenna set, to a handset, and generally to any portable wireless device, which includes an antenna for receiving and transmitting electromagnetic wave signals.

It is an object of the present invention to provide an antenna set for a handset or portable wireless device (such as, for instance, a mobile phone, a smartphone, a PDA, an MP3 or other portable music player, a headset, a USB dongle, a laptop, a PCMCIA or Cardbus 32 card), or even for automotive applications, wherein the antenna set comprises at least one conductive element that is used to tune the frequency response of the ground plane of the antenna set, and enhance its radioelectric performance. Another aspect of the invention relates to a method to improve the bandwidth, the number of operating bands, the voltage standing wave ratio (VSWR), the efficiency and/or the gain of an antenna set in at least one of its operating bands, by tuning the frequency response of the ground plane of the said antenna set by means of a conductive element. The invention also relates to this novel use of the conductive element.

BACKGROUND OF THE INVENTION

A typical antenna set for portable wireless devices (such as, for instance, and without limitation, a handset, a mobile phone, a smartphone, a PDA, an MP3 player, a headset, a USB dongle, a laptop, a PCMCIA or a Cardbus 32 card), comprises at least one antenna element and a ground plane.

In general, said at least one antenna element includes a conductive plate or wire usually mounted on a carrier made of plastic (such as for instance Poly Carbonate, Liquid Crystal Polymer, Poly Oxide Methylene, PC-ABS, or PVC) that provides mechanical support, or instead directly mounted on the plastic enclosure of a portable wireless device (such as for instance a backcover). The antenna element is assembled in the portable wireless device, forming an integral part of the device. The portable wireless device will usually comprises a multilayer printed circuit board (PCB) which carries the electronics. One of the layers of the said multilayer PCB typically serves as a ground plane of the antenna set.

The trend in the sector of mobile phone manufacturers, and more generally portable wireless device manufacturers, is to integrate more and more mobile communication services (such as for instance, but not limited to, GSM850, GSM900, GSM1800, American GSM or PCS1900, GSM450, UMTS, WCDMA, or CDMA), together with added-value services allowing high data rate functionality (such as, for example, multimedia services, or on-line video), wireless connectivity and/or geolocalization (such as for example, but not limited to Bluetooth™, IEEE802.11a, IEEE802.11b, IEEE802.11g, WLAN, WiFi, UWB, ZigBee, GPS, Galileo, SDARs, XDARS, WiMAX, DAB, FM, DVB-H, or DMB) in more and more of their products At the same time, mobile phone manufacturers experience a strong market pressure to commercialize smaller-sized and less expensive devices.

These two market trends are in conflict because of the known trade-off between the performance of an antenna element and its size. As the size of handsets shrinks, and with it the space available to integrate the antenna element, the electrical performance of the antenna element (e.g., bandwidth, efficiency, or gain) degrades, thus hampering the ability of the antenna element to operate simultaneously in multiple bands. Furthermore, a ground plane of reduced dimensions (relative to the wavelength at the frequencies of operation of the antenna set) is of little help in enhancing the radiation properties of the antenna element.

Some attempts have been made to design antenna sets able to operate in multiple frequency bands, with an adequate electrical performance in each frequency band. They include the use of external monopole-type antennas, or antennas that comprise materials with high dielectric constant.

In the case of an external monopole antenna, the antenna element extends either partially or totally outside of the enclosure of the portable wireless device. Although multiband performance can be obtained, this solution is not satisfactory for small-sized portable wireless devices, because the external antenna implies an increase in the overall dimensions of these devices. Also, a wireless device using this type of antennas is likely to suffer from higher levels of specific absorption rate (SAR).

As mentioned, another possibility is the use of antenna elements comprising materials with high dielectric constant. Although these materials are effective in miniaturizing the dimensions of the antenna element, they are expensive and involve complex manufacturing processes, which make this approach unattractive for low-cost portable wireless devices.

Alternatively, rather than integrating all the operating bands in a single antenna element (which is likely to perform poorly in some bands), it is sometimes preferred to have two antennas inside the portable wireless device. For example, one antenna can be used to provide the GSM services, while another antenna can be used for UMTS. Although this approach alleviates the design complexity of each one of the antennas, in many cases it might not be practical, due to the little space available for the antennas inside the device, the increased complexity of the electronic circuitry to which the antennas are connected, and undesired coupling effects between the antennas. Moreover, such a solution can be expensive, and complicate the manufacturing process of a portable wireless device, since two antenna elements need to be provided and assembled into the device.

Another prior art solution is disclosed in WO-A-03/023900, further discussed below.

SUMMARY OF THE INVENTION

The present invention relates to a novel type of antenna set that comprises a conductive element used to tune the frequency response of the ground plane and enhance the radiation process of the antenna set. According to the present invention, said conductive element allows enhancing the radioelectric performance of the antenna set in at least one of its operating bands, and/or increase the number of bands in which the antenna set can operate simultaneously. This solution is essentially different from the previous ones, as it is geared towards enhancing the radioelectric performance of the antenna set by acting on the ground plane of a portable wireless device, rather than on the antenna element itself. According to the present invention, the conductive element is connected to, or coupled with, the ground plane of the portable wireless device in order to tune its frequency response and improve the behavior of the antenna set in at least one of its operating bands.

The invention disclosed in this document is also different from the technique previously disclosed in the above-mentioned WO-A-03/023900 (Multilevel and Space-filling ground planes for miniature and multiband antennas), and referred to as "FracPlane", in which the frequency response of an antenna set is tailored by shaping the ground plane of said antenna set. According to the teachings of WO-A-03/023900, the ground plane of an antenna set can be shaped or modified (such us for example, but not limited to, by creating slots within the extension of the ground plane) to force the currents to flow in a way that enhances the behavior of the whole antenna set.

Despite the benefits of this technique, a "FracPlane" solution might not always be possible or adequate. In some cases the small form factors of the PCBs of portable wireless devices and the high density of component integration on the PCBs leave little room to an antenna designer to shape the ground plane to include gaps, slots or openings as it would be necessary to obtain good antenna performance. Moreover, even minimal changes in the design of the ground plane of the PCB of the wireless device might result in major redesigning of the placement and routing of the on-board electronic components.

Instead, the invention here disclosed does not involve changing or modifying the shape of the ground plane of an antenna set, but complementing it by means of an additional conductive element coupled to the ground plane (such as, for example, through some circuit element) which does not need to be integral to the ground plane, thus overcoming some of the limitations of the "FracPlane" solution.

Thus, the present invention relates to an antenna set for a handset, and generally for any portable wireless device (such as for instance a mobile phone, a smartphone, a PDA, an MP3 player, a headset, a USB dongle, a laptop, a PCMCIA or Cardbus 32 card), and also for automotive applications, wherein said antenna set features a ground plane complemented with said conductive element, so as to enhance the radioelectric performance of the antenna set in at least one of its operating bands.

An antenna set including a complemented ground plane according to the present invention comprises at least one antenna element, a ground plane, and a conductive element, different from said at least one antenna element (that is, additional to said antenna element), which is used to tune the frequency response of the ground plane and to enhance the radiation process of the whole antenna set, thereby increasing the bandwidth, the number of operating bands, the voltage standing wave ratio (VSWR), the efficiency and/or the gain of the antenna set in at least one of its operating bands (all throughout said operating band(s), or at least in a portion of said operating band(s)). The conductive element is connected to, or coupled with, the ground plane of the antenna set, without being an integral part of said ground plane.

In the present document, the expression operating band can be understood as defining a frequency band having a lower frequency limit ($f_{min}$) and an upper frequency limit ($f_{max}$), and wherein one or more relevant parameters of the antenna set (such as, for example, the return loss, the voltage standing wave ratio (VSWR), the radiation efficiency, the antenna efficiency—that is, the combination of the radiation efficiency and the miss match losses—and/or the gain) of the antenna element(s) comply with a condition within said frequency band.

In the context of the present invention and document, a suitable condition can be, for example, the return loss of the antenna element, whereby an operating band can be considered to be a frequency band with a lower frequency limit ($f_{min}$) and an upper frequency limit ($f_{max}$), the return loss remaining below (that is, in this case, remaining more negative than) a certain threshold for all frequencies within said frequency band. Said threshold can typically be −6 dB, −5 dB, −4 dB or −3 dB.

These values correspond to typical requirements on antenna sets suitable for supporting certain wireless services at frequencies within said operating bands. Normally, each wireless service implies certain conditions that the antenna should comply with in a relevant frequency band. If the antenna has an operating band compatible with the relevant service, this means that the operating band is wide enough to accommodate the wireless service, that is, that the operating band has a sufficient bandwidth within which it complies with the relevant requirements concerning gain, VSWR, return-loss, antenna efficiency, radiation efficiency and/or other relevant parameters. Often, one operating band of an antenna can accommodate more than one wireless service. Typical wireless services can be, for example, GSM850, GSM900, GSM1800, American GSM or PCS1900, GSM450, UMTS, WCDMA, CDMA, Bluetooth™, IEEE802.11a, IEEE802.11b, IEEE802.11 g, WLAN, WiFi, UWB, ZigBee, GPS, Galileo, SDARs, XDARS, WiMAX, DAB, FM, DMB, DVB-H. These services are allocated to different frequency bands and imply different requirements on antenna performance.

Thus, by means of the conductive element of the invention, it is possible to adapt the performance of a certain antenna set comprising an antenna element and a ground plane, without altering said antenna element or ground plane. The conductive element can thus be used to "tune" the antenna set, so as to modify one or more of its radioelectric parameters, for example, so as to increase the number of operating bands (that is, by adding one or more operating bands) and/or the bandwidth of at least one operating band of the antenna (for example, increase the absolute bandwidth of at least one operating band by 5%, 10%, 15%, 20%, 25% or even more), by increasing the return-loss, VSWR, gain, radiation efficiency and/or antenna efficiency in correspondence with one or more operating bands of the antenna. In this way, a specific antenna set comprising antenna element and ground plane can be adapted to support certain wireless services not originally supported by the antenna set, and/or to better support one or more of the originally supported services.

The above-mentioned effects of the invention (that is, increasing the number of operating bands, the bandwidth of at least one operating band, the return-loss, VSWR, gain, radiation efficiency and/or antenna efficiency) can take place within a frequency range in which the relevant services supported by the antenna set (and, optionally, by the corresponding portable wireless device) are allocated. For example, in the case of an antenna set or wireless device supporting GSM and UMTS, this frequency range could be 700 MHz (or 800 MHz)-3000 MHz (or 2500 MHz), thus encompassing the typical frequency bands corresponding to GMS 850, GMS 900, GSM 1800 and UMTS, and some further typical frequency bands for cellular mobile telephony.

The contribution of the (at least one) conductive element can correspond to an increase of the effective electrical length of one or more paths (and/or alteration of the shape of said path or paths) followed by currents in the ground plane (and in the corresponding conductive element), and/or reside (at least partially) in the conductive element or elements acting as parasitic elements with respect to the antenna element (the active radiating element).

Accordingly, in some cases, it can be advantageous to use a conductive element having an effective electrical length of approximately one quarter of the wavelength (λ/4) corresponding to the frequency where a change is wanted in the frequency performance of the antenna set, for example, for addition of a further operating frequency band around said frequency, or for increasing the bandwidth (the absolute bandwidth, that is, $f_{max}$-$f_{min}$, and/or the relative bandwidth, that is, the absolute bandwidth divided by the centre frequency of the frequency band) of an already existing operating band, so as to include a certain frequency or frequency band within the operating band, and/or for enhancing the radioelectric performance of the antenna set in correspondence with said frequency. This can enhance the parasitic performance of the conductive element with regard to the antenna element, in the relevant frequency range.

In other cases, the primary function of the conductive element can be to extend the effective electrical length of the ground-plane. If so, the length of the conductive element can be chosen so as to constitute, together with the ground-plane, at least one electric path having an effective electrical length corresponding to approximately half of the wavelength (λ/2) corresponding to the frequency where a change is wanted in the frequency performance of the antenna set. In some embodiments, said at least one electric path preferably having an effective electrical length corresponding to approximately 0.4*λ. Also, this effective electrical length can be influenced by the choice of circuit element (such as an inductive element), when such a circuit element is used for connecting or coupling the conductive element to the ground-plane of the PCB. Thus, the choice and/or state of the circuit element can be used for (further) "tuning" the frequency response of the antenna set.

Another aspect of the invention relates to the use of at least one circuit element (such as, for example, an inductive element, a capacitive element, a resistive element, a jumper, or a bypass) to provide the coupling between said conductive element and the ground plane of the antenna set.

A further aspect of the invention relates to a method to improve the radioelectric performance of a multiband antenna set (for example, its bandwidth, the number of operating bands, its VSWR, its efficiency and/or its gain) in at least one of its operating bands, by tuning the frequency response of the ground plane of said antenna set with at least one conductive element. The invention also relates to a method to reduce the size of a multiband antenna element while keeping its target radioelectric performance, by tuning the frequency response of the ground plane by means of at least one conductive element.

Some aspects of the invention are defined in the independent claims. Some embodiments of the invention are defined in the dependent claims.

One aspect of the invention corresponds to an antenna set comprising:

at least one antenna element, a ground plane (such as a ground plane comprising a conductive layer or part of a conductive layer of a printed circuit board), and a conductive element, different from said at least one antenna element, to enhance the radioelectric performance of the antenna set in at least one operating band of the antenna set.

The ground plane comprises a first edge and a second edge, with the first edge and the second edge being the two farthest apart opposite edges of the ground plane (such as the short edges or sides of a substantially rectangular ground plane), and the antenna element is arranged within the antenna set substantially near the first edge of the ground plane, while the conductive element comprises at least one contact to couple said conductive element to the ground plane, with the at least one contact being located closer to the second edge of the ground plane than to the first edge of the ground plane.

This position of the contact makes it possible to extend the electric paths (for the currents induced by the radiating antenna element) determined by the ground plane itself (to achieve this effect, the conductive element could advantageously be coupled close to an end of the ground-plane away from the end where the antenna element is arranged, for example, at a distance from the second edge that is less than, for example, 5%, 10%, 15%, 20%, 25%. 30% or 40% of the distance between the first edge and the second edge), and/or to cause the conductive element to efficiently act as a parasitic element with respect to the antenna element (the parasitic element should then preferably not be arranged too close to the antenna element, as this could imply a risk for interferences and cancellation between currents; however, the distance between antenna element and parasitic element should not be too big, in order to allow coupling between the elements).

According to another aspect of the invention, the antenna set, comprises:

at least one antenna element, a ground plane which is integral to a printed circuit board and comprises a conductive layer of said printed circuit board, and a conductive element, different from said at least one antenna element, to enhance the radioelectric performance of the antenna set in at least one operating band of the antenna set. The ground plane includes a first edge and a second edge, with the first edge and the second edge being the two farthest apart opposite edges of the ground plane. The at least one antenna element is mounted on the printed circuit board substantially near said first edge. The conductive element is not an integral part of the printed circuit board. The orthogonal projection of said conductive element on the ground plane is such that there is an overlap region with the ground plane. Said conductive element comprises a first portion closer to the first edge than to the second edge, and a second portion closer to the second edge than to the first edge, and the conductive element further comprises at least one contact that couples said conductive element to the ground plane of the printed circuit board. This at least one contact is located within the first portion of said conductive element. Thus, connection or coupling between conductive element and ground plane can take place closer the first edge than to the second edge.

In this way, the conductive element can, for example, itself act as some kind of "prolonged" ground plane. In this way, the ground-plane can be "extended" without affecting the ground-plane of the printed circuit board. The conductive element can be provided with slots or similar so as to increase an electric path along said conductive element.

The claims define different preferred positions of the antenna element and the conductive elements. In many cases, it can be convenient to have the conductive element coupled to the ground plane close to the second edge of the ground-plane (such as, for example, at said edge, or within 10% of the length of the ground-plane from said edge).

The conductive element(s), the antenna element(s) and/or the ground plane can have conductive portions shaped as a space-filling curve, and/or a box-counting curve, and/or a grid curve, or shaped as a multi-level structure.

The antenna set can further comprise means for selectively modifying the coupling between the conductive element and the ground plane, so as to modify the frequency response of the ground plane. This makes it possible to modify the "tuning" of the ground-plane, and thus the radioelectric performance of the antenna set, without altering the conductive element. This can be useful for allowing standard elements to be used for manufacturing wireless devices and for "tuning" the devices in accordance with, for example, different national and regional conditions, such as in accordance with the specific frequency bands allotted to certain services in certain states or regions. Said means for selectively modifying the coupling can comprise, for example, at least one variable impedance element and/or a plurality of contacts and means for selectively activating said contacts (for example, such that one contact is used in one specific region and another one in another region).

The invention also relates to a portable wireless device (such as, for example, a handset for mobile telephony and/or for other mobile services) including an antenna set as outlined above.

Another aspect of the invention relates to a use of the conductive element in an antenna set as outlined above, for tuning the frequency response of the ground plane, and/or for increasing the bandwidth of at least one operating band of the antenna set, and/or for increasing the number of operating bands of the antenna set, and/or for enhancing the voltage standing wave ratio within at least one operating band of the antenna set, and/or for enhancing the radiation and/or efficiency of the antenna set within at least one operating band of the antenna set, and/or for enhancing the gain of the antenna set within at least one operating band of the antenna set, and/or for reducing the size of the antenna set. This use can be especially useful when applied to portable wireless devices.

The invention also relates to a corresponding method. The method is advantageously applied to portable wireless devices, for improving their performance while maintaining (or even reducing) their sizes.

LIST OF FIGURES

Further characteristics and advantages of the invention will become apparent in view of the detailed description-which follows of some preferred embodiments of the invention, given for purposes of illustration only and in no way meant as a definition of the limits of the invention, made with reference to the accompanying drawings, in which:

FIG. 1—Perspective view of examples of a PCB of a portable wireless device provided with a conductive element to tune the frequency response of the ground plane of the PCB.

Figure 2:
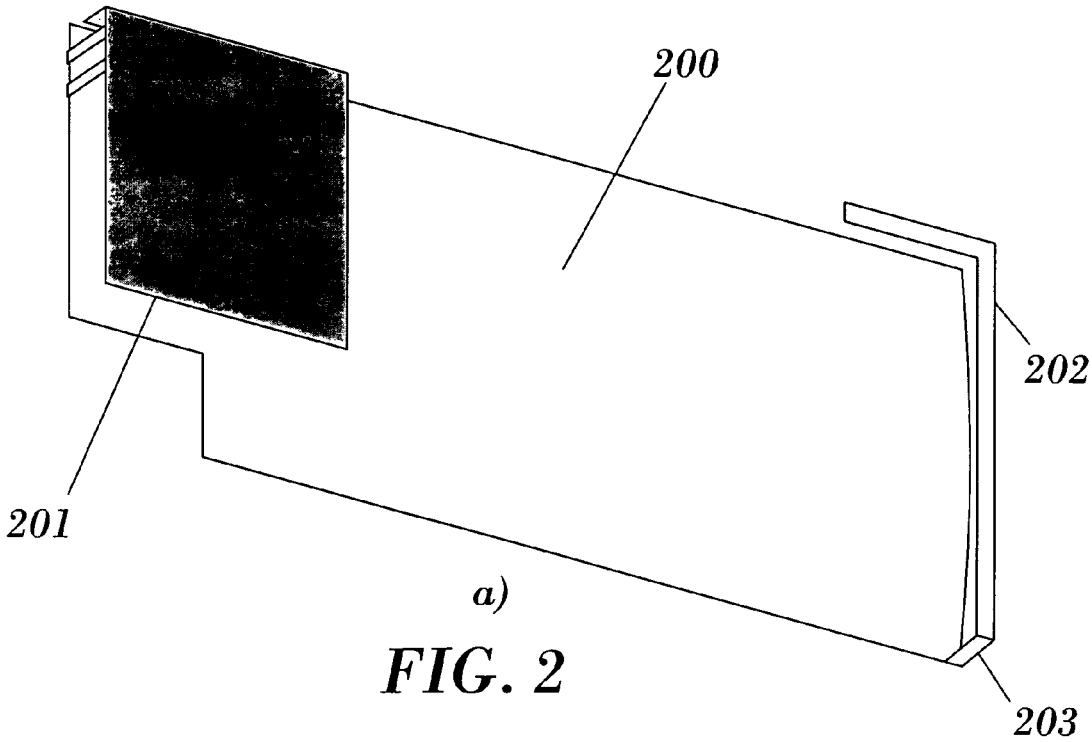
Figure 2:
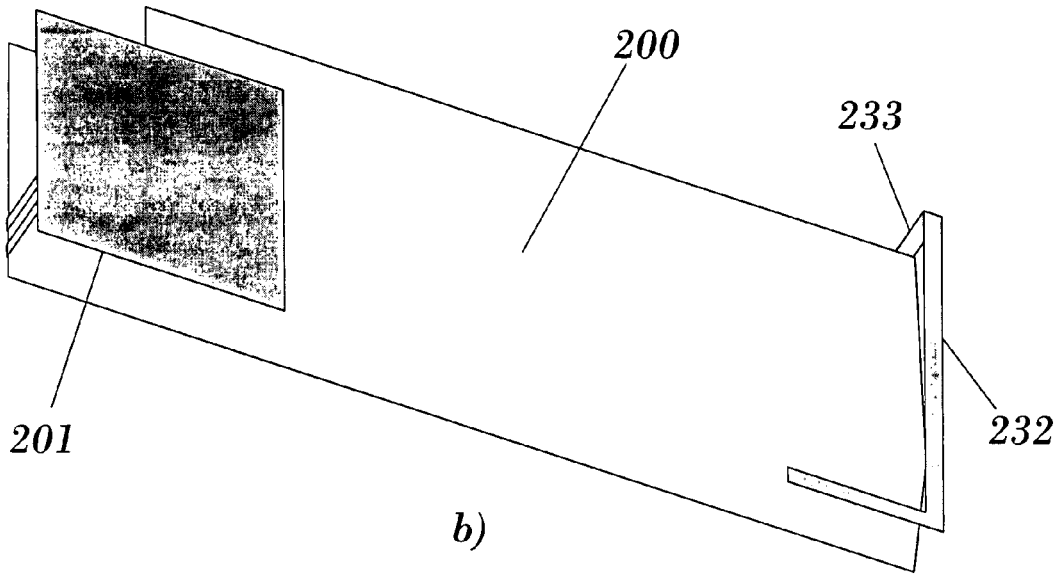
Figure 2:
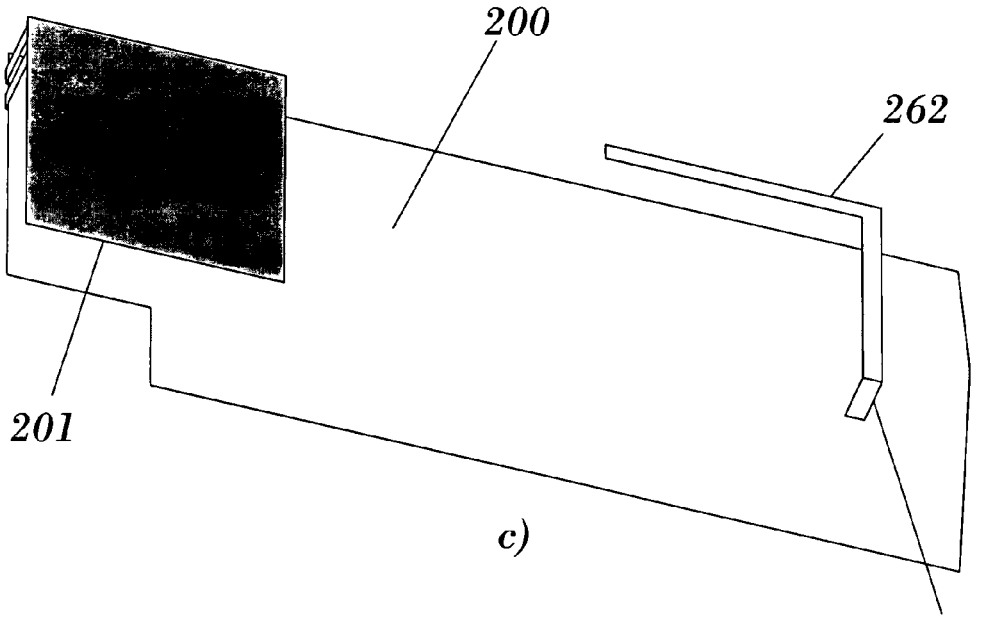

FIG. 2—Perspective view of the PCB of a wireless device provided with an elongated conductive element connected or coupled to the ground plane.

Figure 3:
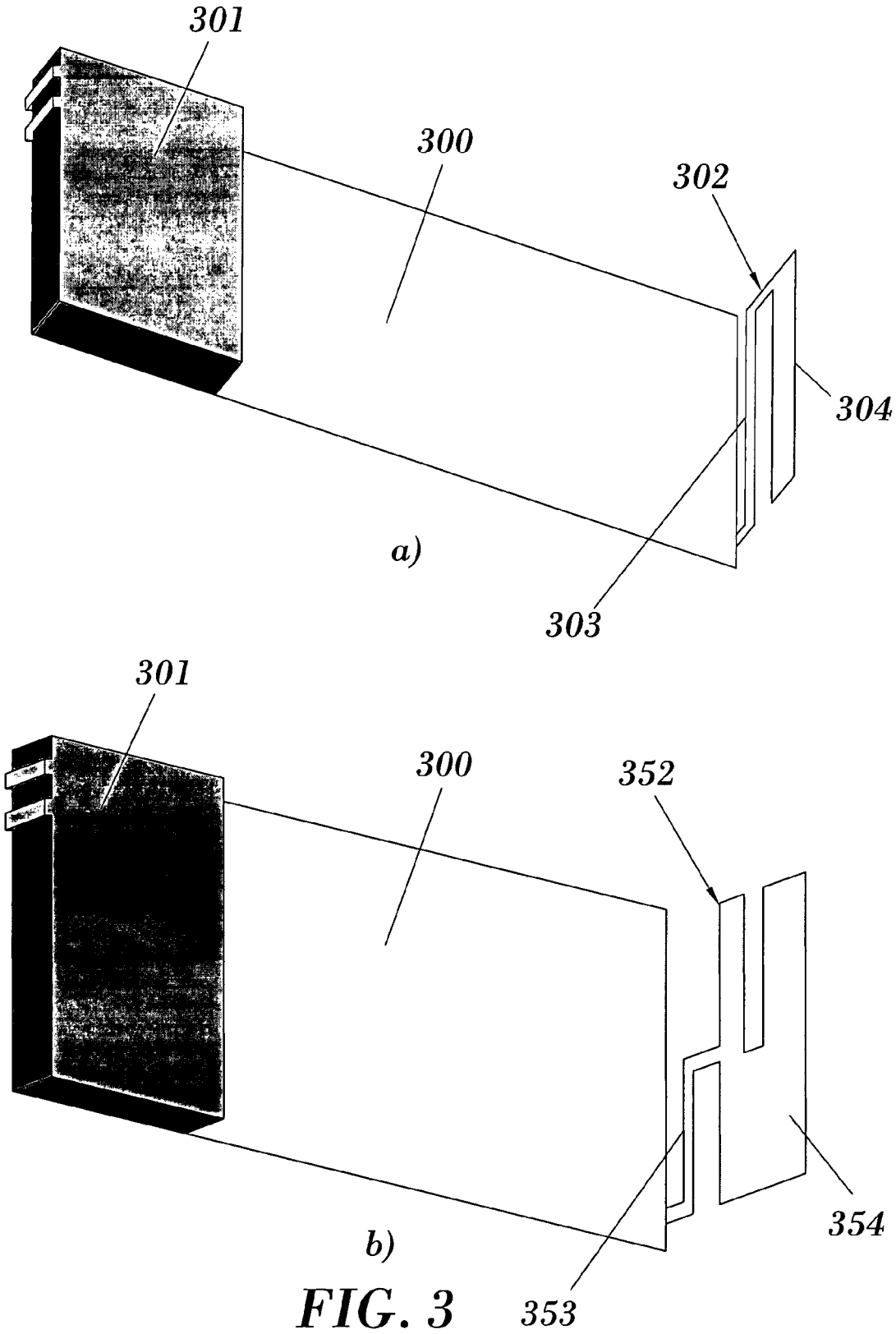

FIG. 3—Examples of antenna sets wherein the conductive element is formed by a combination of plates and elongated portions.

Figure 4:
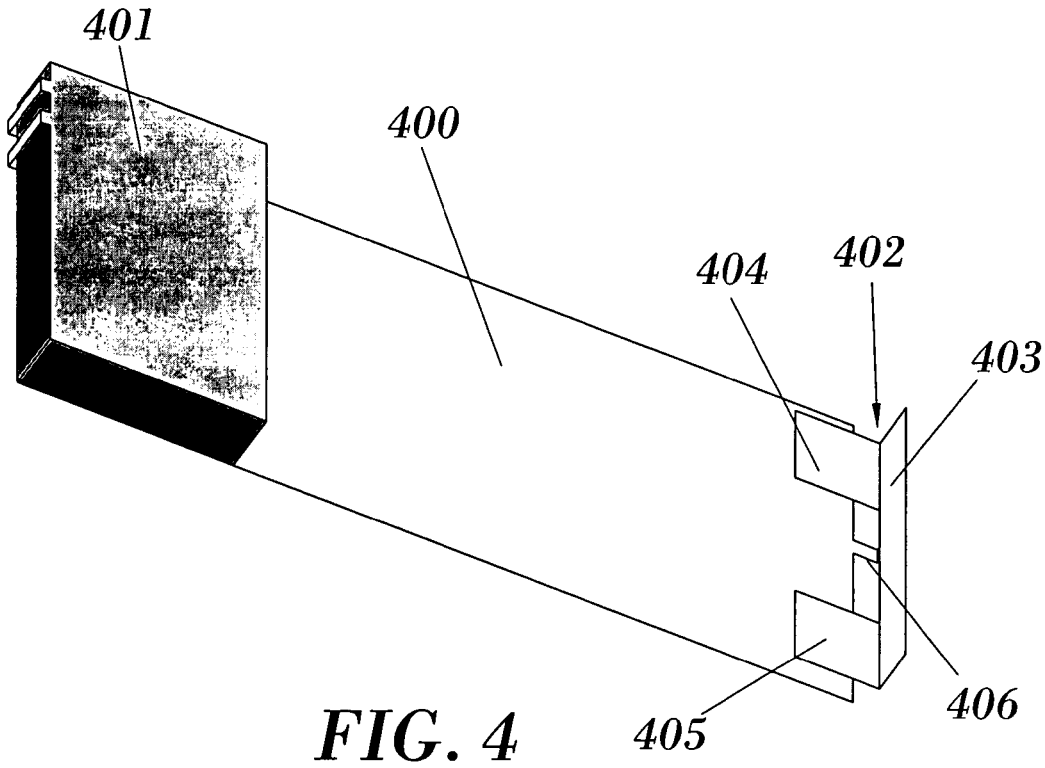

FIG. 4—Example of an antenna set wherein the conductive element used to tune the ground plane of the PCB includes a three-dimensional structure.

Figure 5:
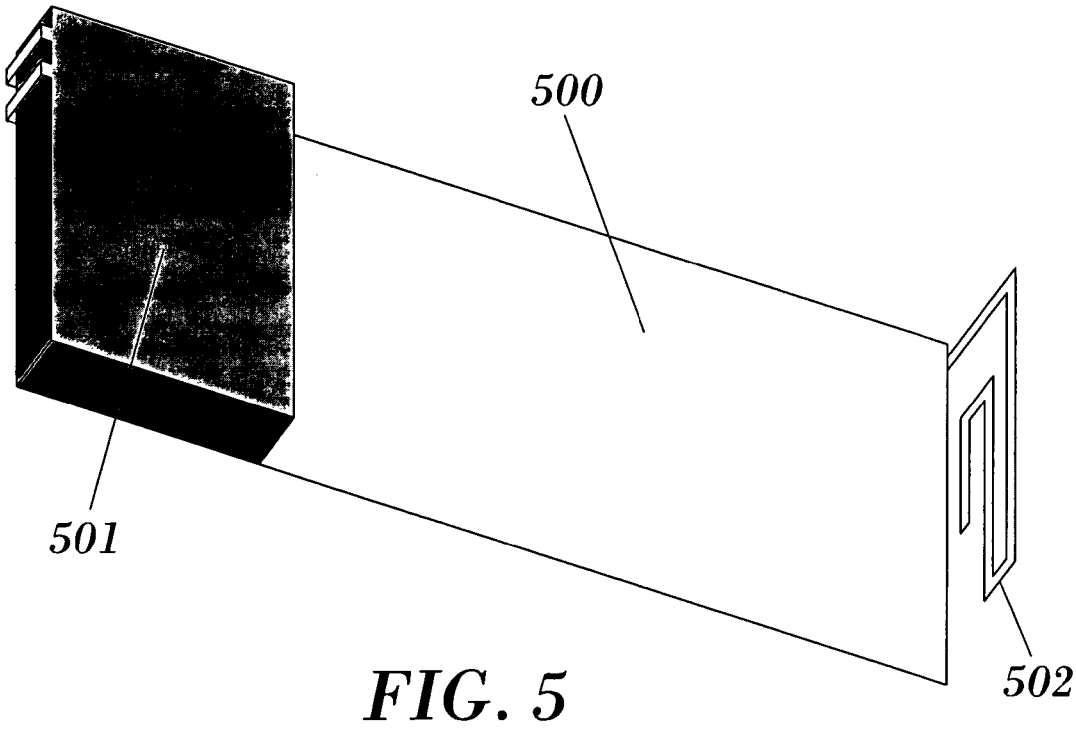

FIG. 5—Perspective view of an antenna set in which the conductive element is formed by a plurality of segments or strips arranged as a planar structure.

Figure 6:
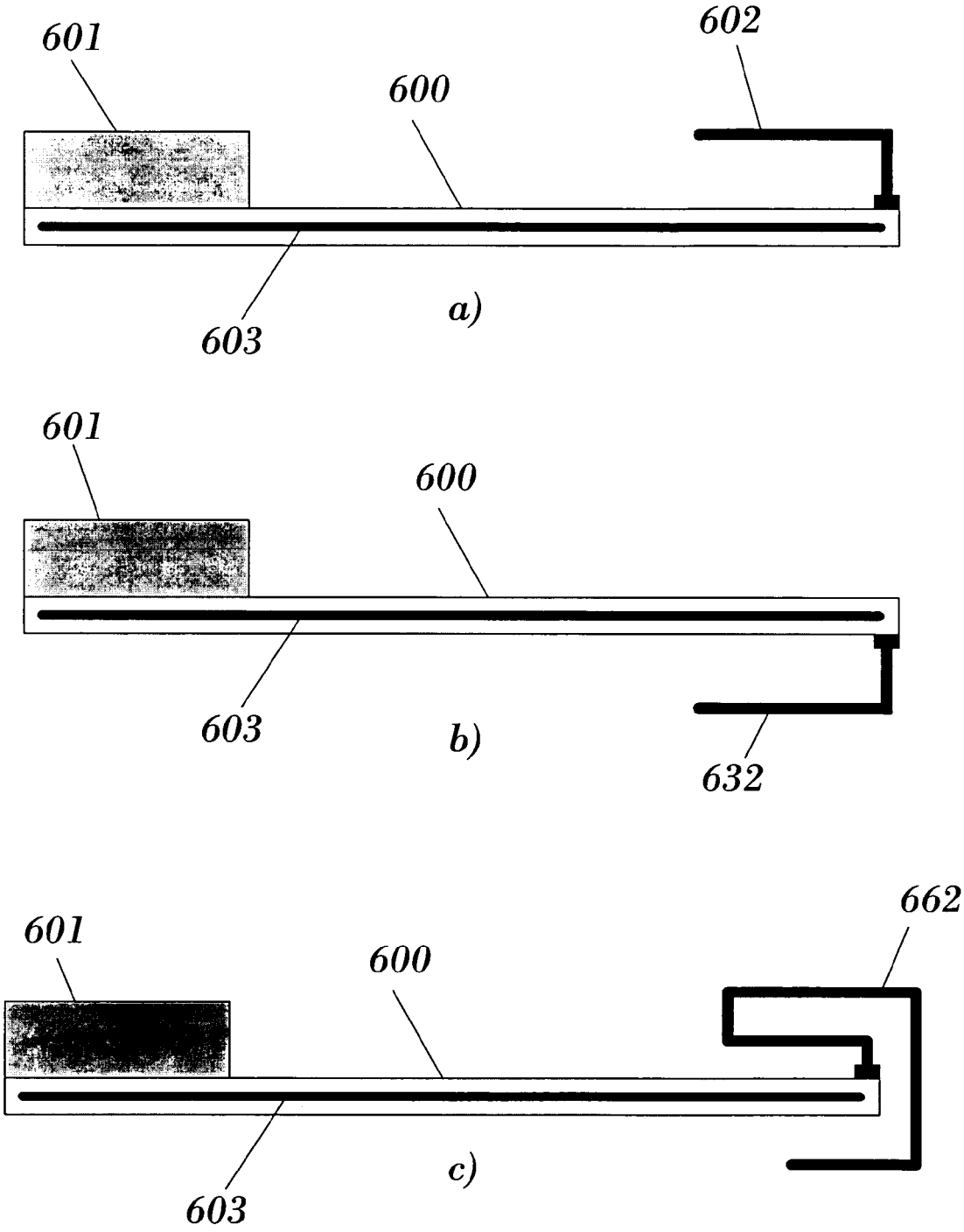

FIG. 6—Side view of the PCB of a portable wireless device: (a) with the conductive element mounted on the top surface of the PCB; (b) with the conductive element mounted on the bottom surface of the PCB; or (c) in which the conductive element comprises some portions above the top surface of the PCB and some other portions below the bottom surface of the PCB.

Figure 7:
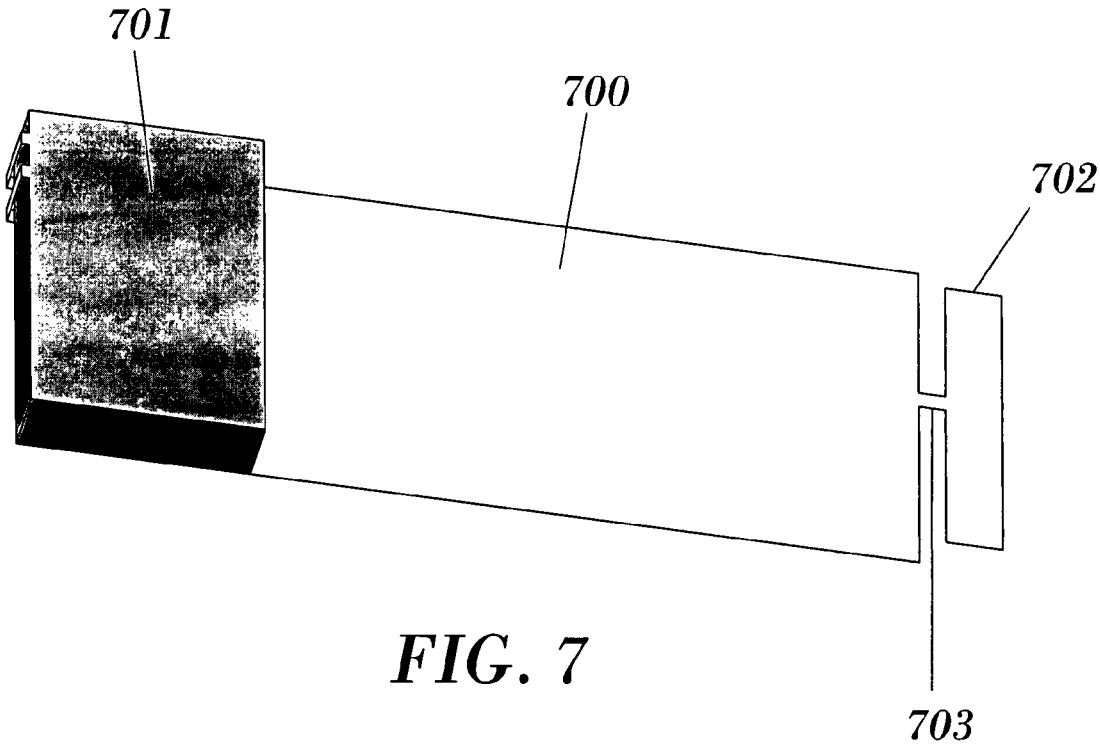

FIG. 7—Example of an antenna set wherein the conductive element is coplanar to the ground plane of the PCB.

Figure 8:
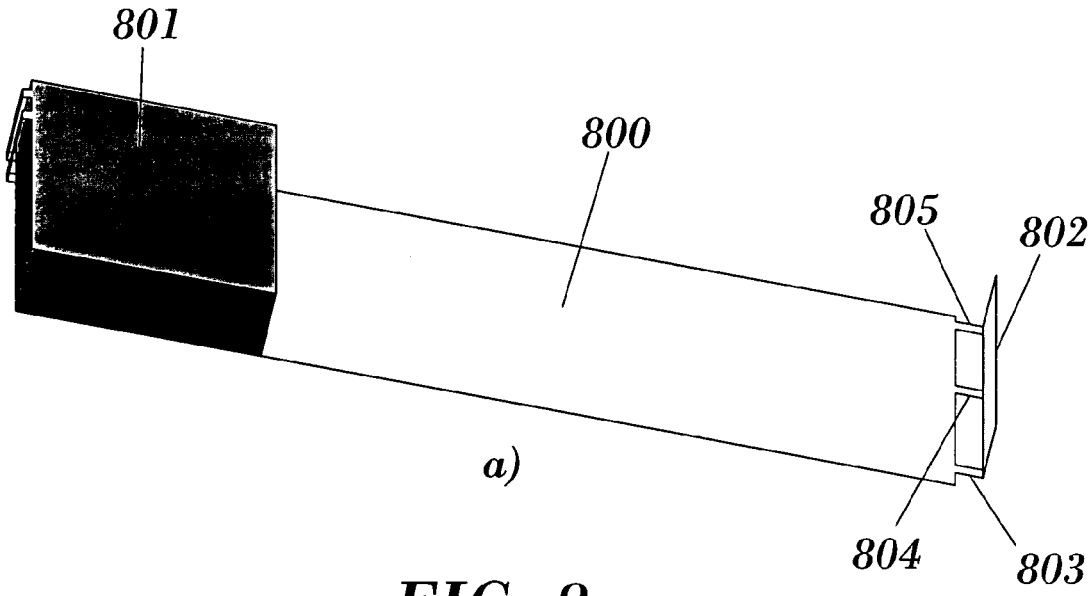
Figure 8:
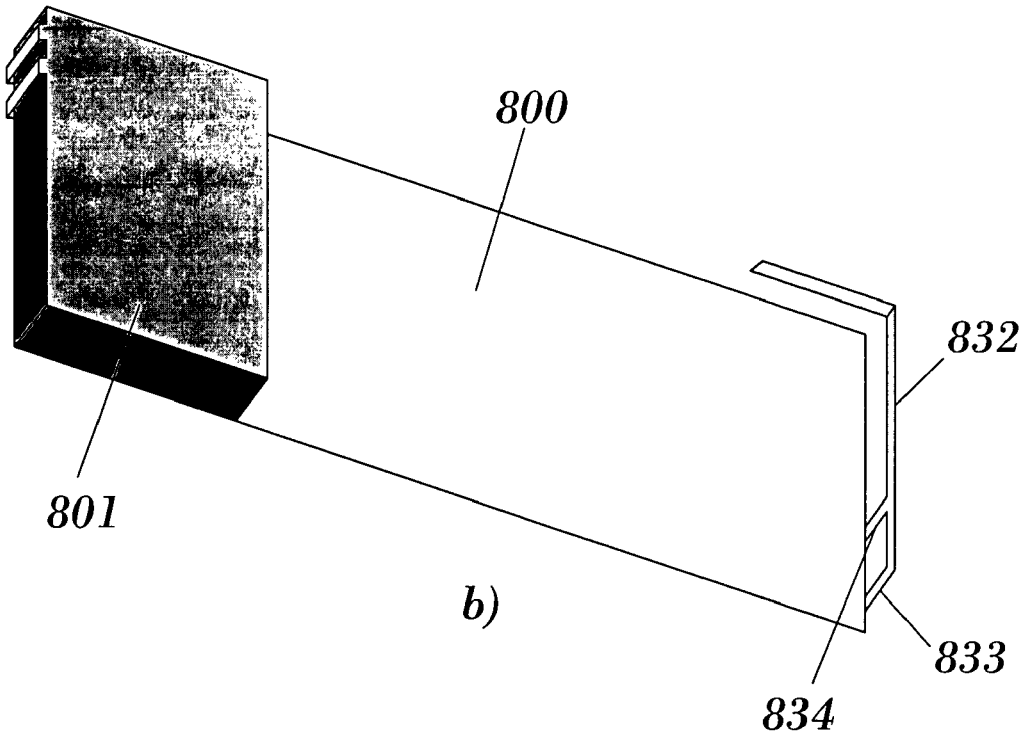
Figure 8:
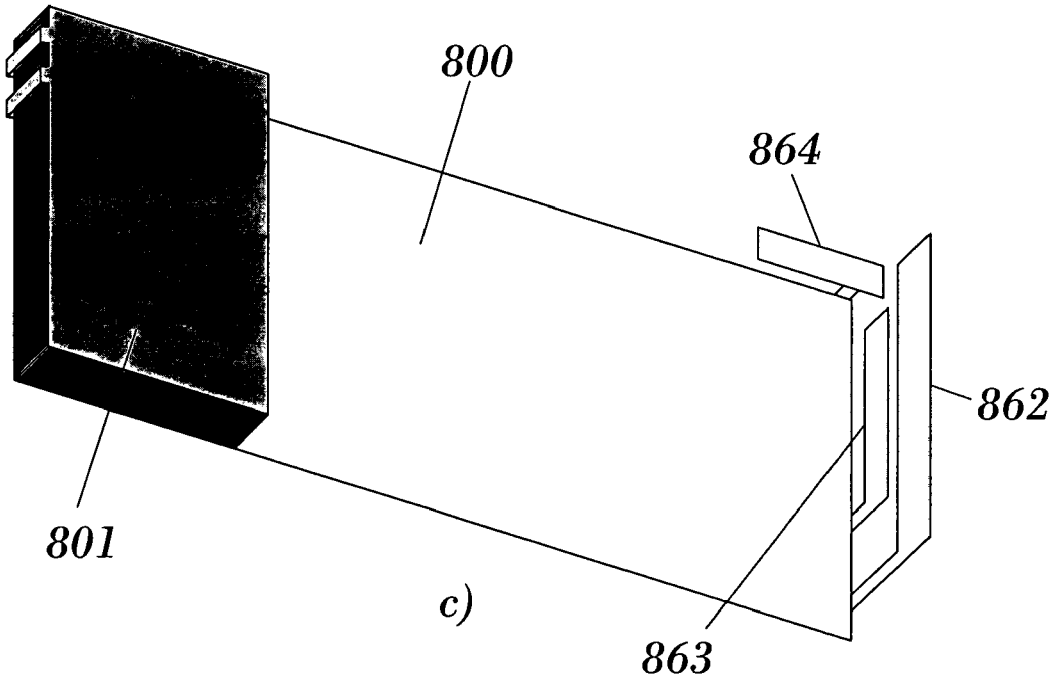

FIG. 8—Perspective views of the PCB of a portable wireless device that includes an antenna set with a conductive element having more than one contact region with the ground plane of the PCB, or more than one conductive element.

Figure 9:
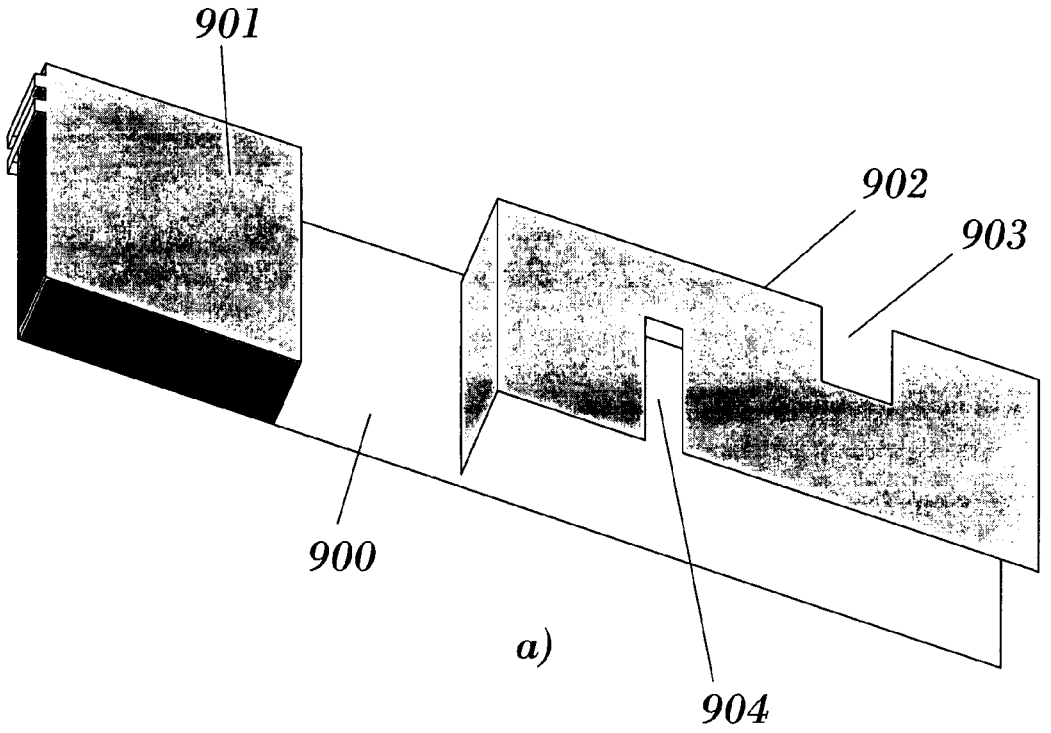
Figure 9:
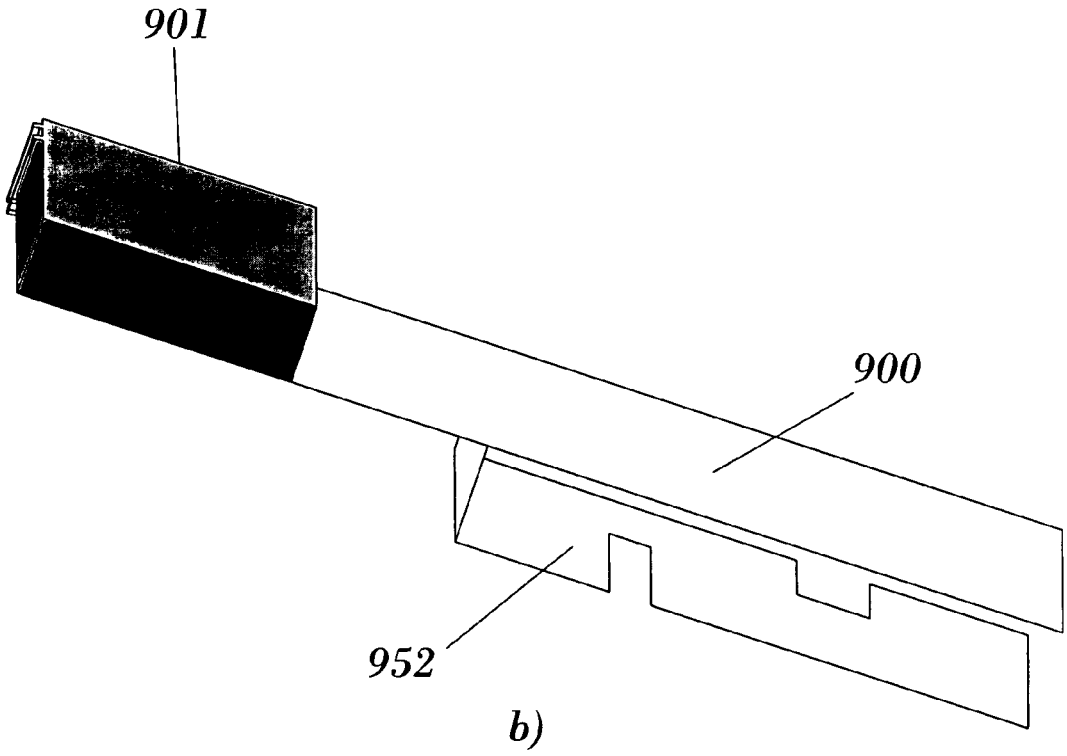

FIG. 9—Examples of an antenna set wherein the orthogonal projection of the conductive element covers a substantial portion of the PCB.

Figure 10:
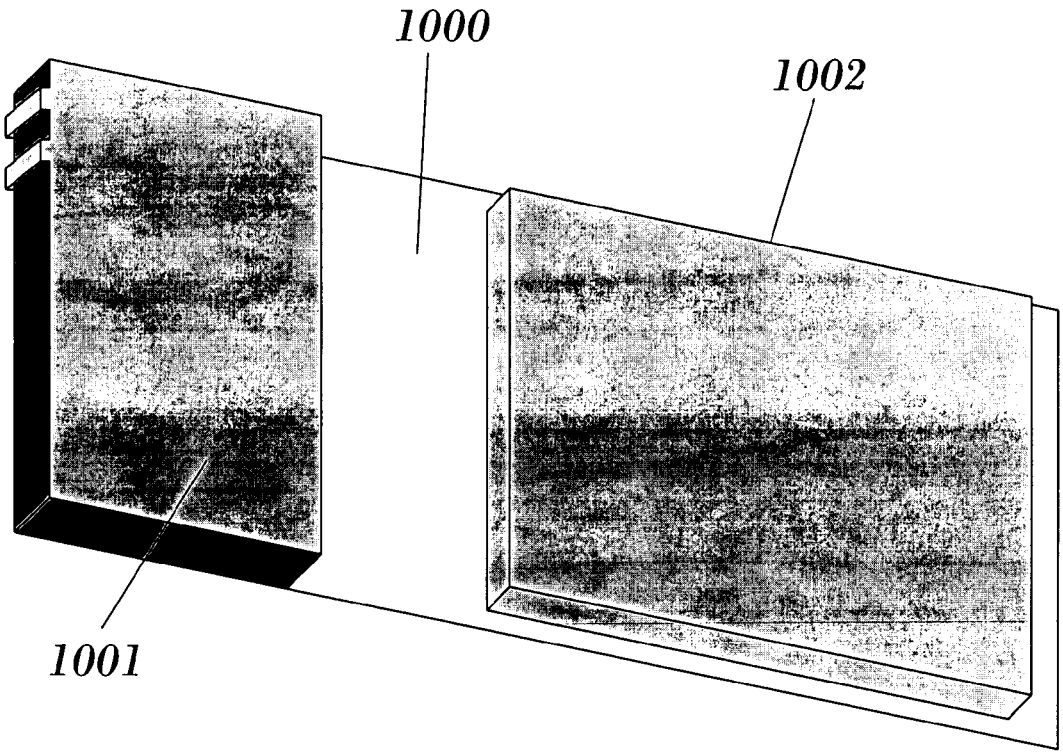

FIG. 10—Example of an antenna set in which the conductive element includes the metal chassis of the battery of the corresponding wireless device.

Figure 11:
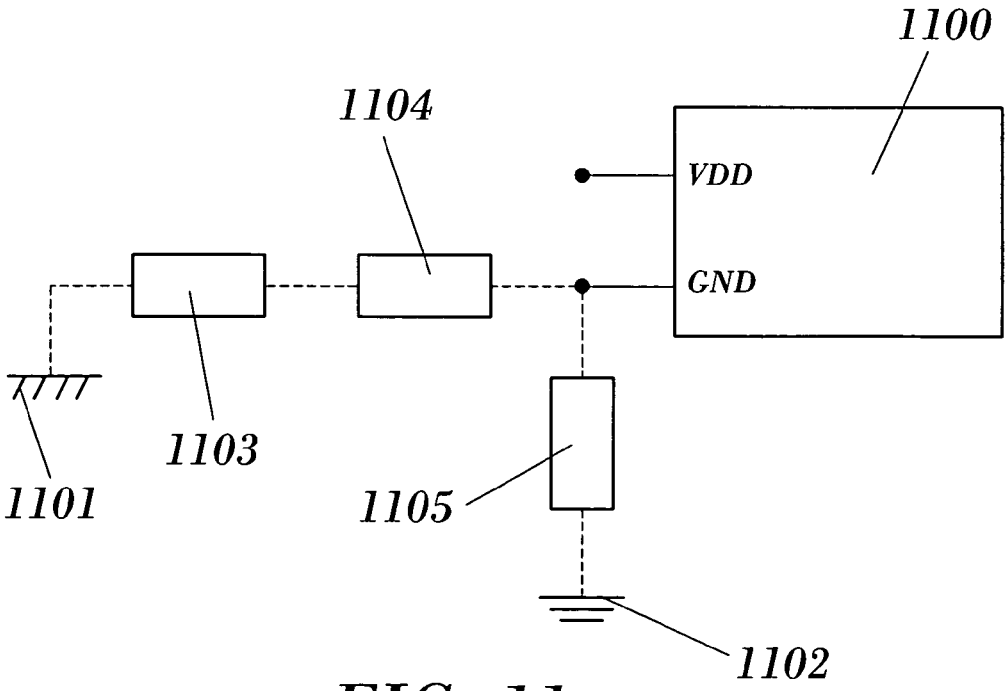

FIG. 11—Schematic circuit diagram of an example of a circuit to couple the chassis of the battery of a portable wireless device to the RF ground plane of said device.

Figure 12:
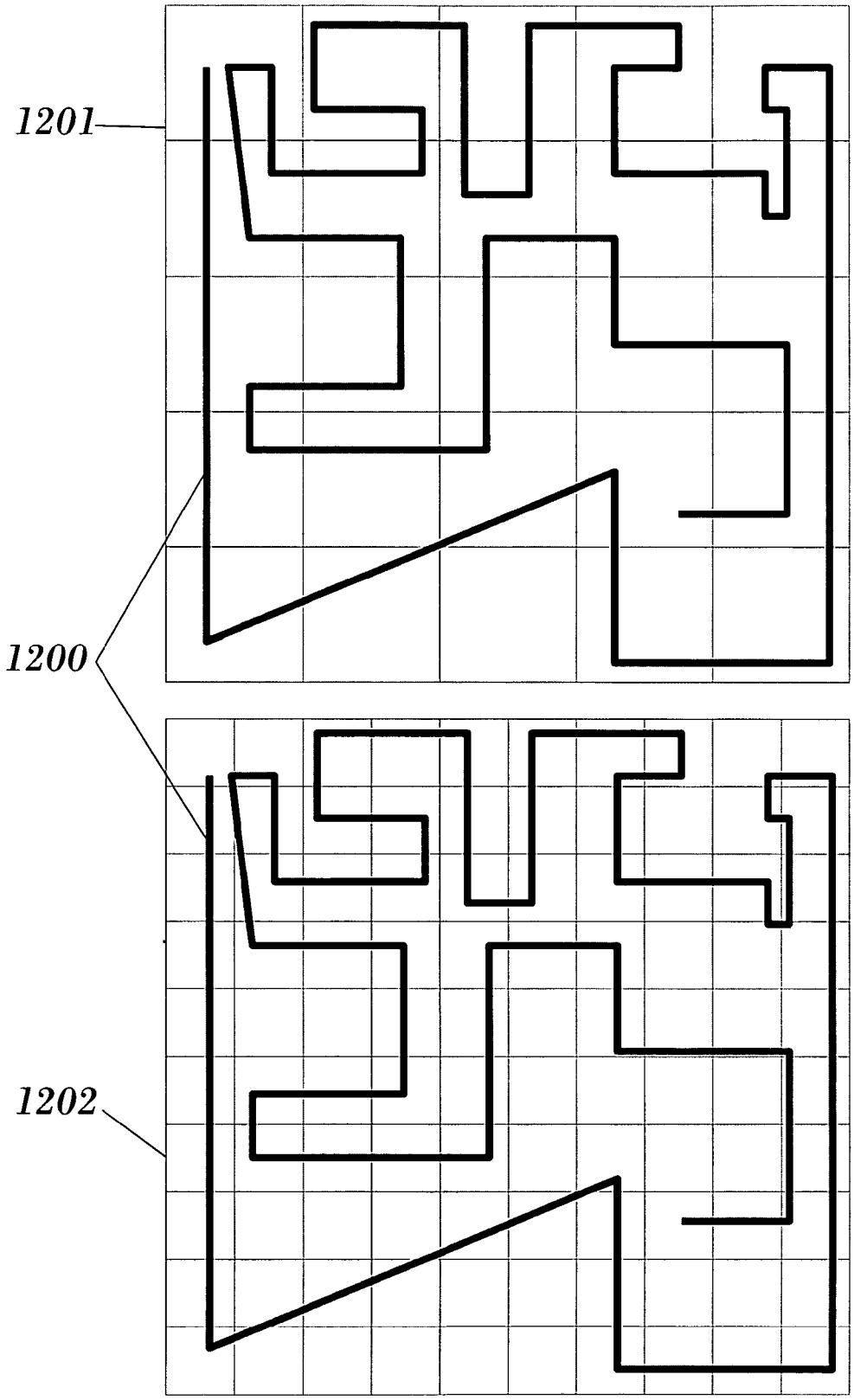

FIG. 12—Example of how to calculate the box counting dimension.

Figure 13:
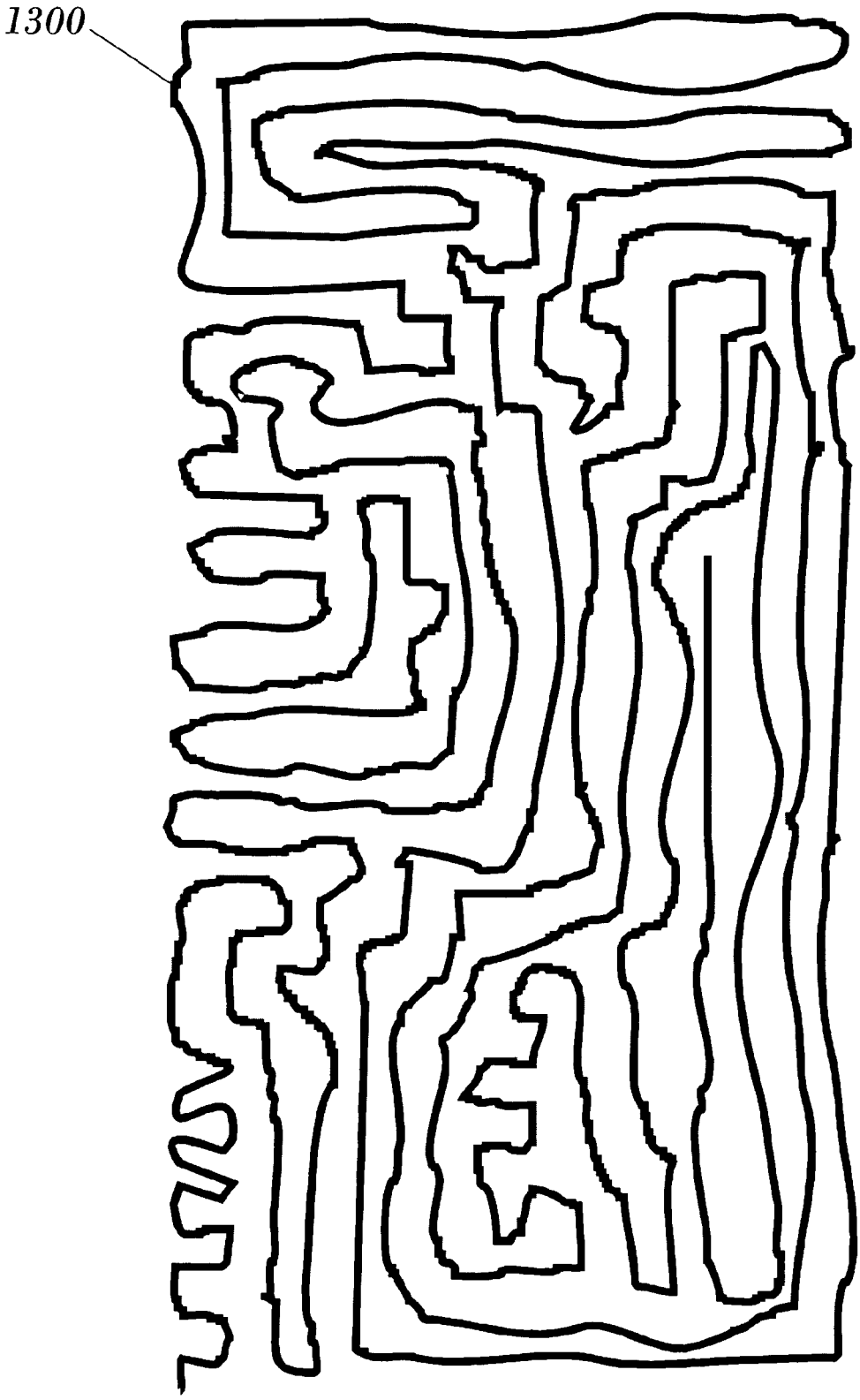

FIG. 13—Example of a curve featuring a grid-dimension larger than 1, referred to herein as a grid-dimension curve.

Figure 14:
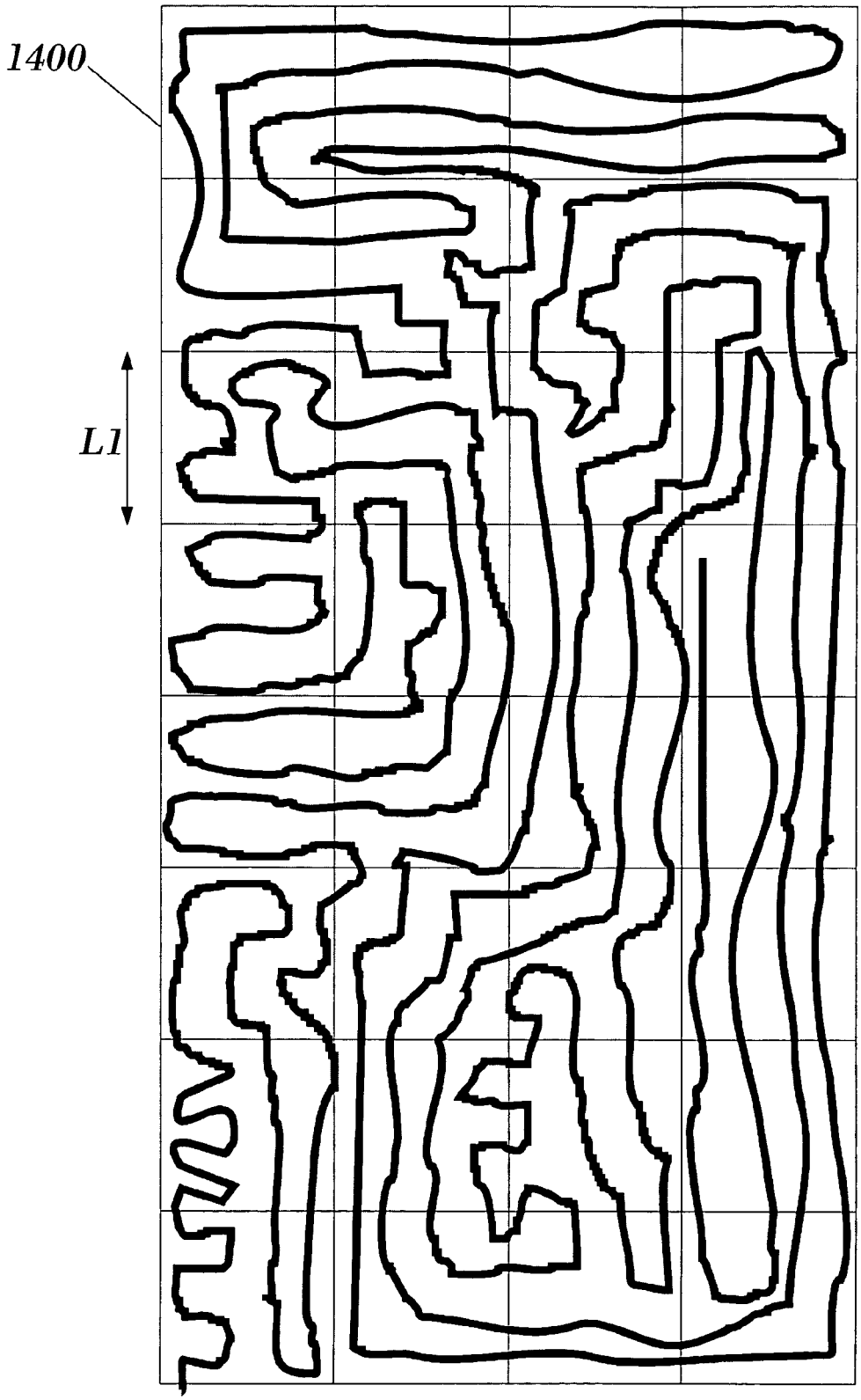

FIG. 14—The curve of FIG. 13 in the 32-cell grid, wherein the curve crosses all 32 cells and therefore N1=32.

Figure 15:
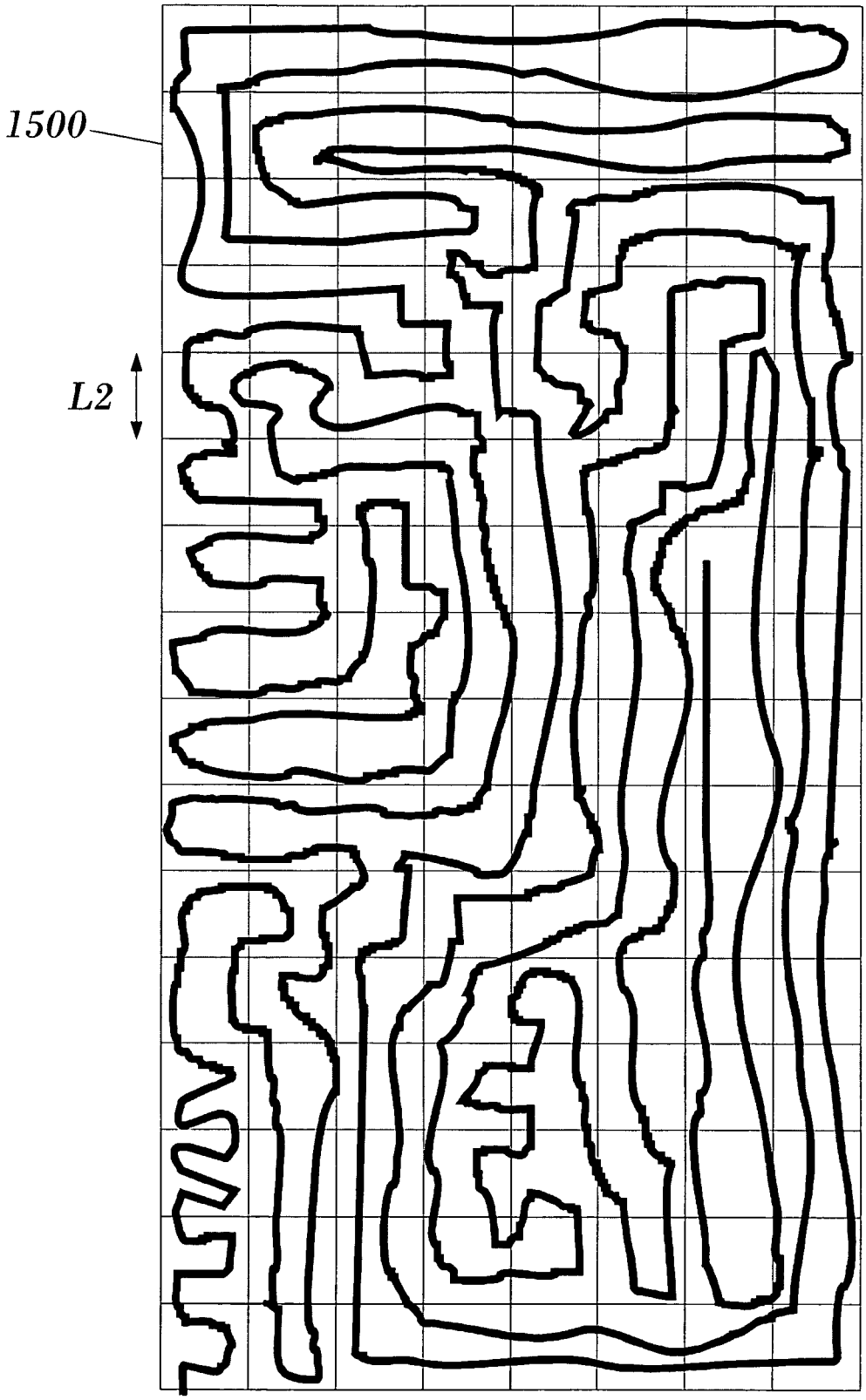

FIG. 15—The curve of FIG. 13 in a 128-cell grid, wherein the curve crosses all 128 cells and therefore N2=128.

Figure 16:
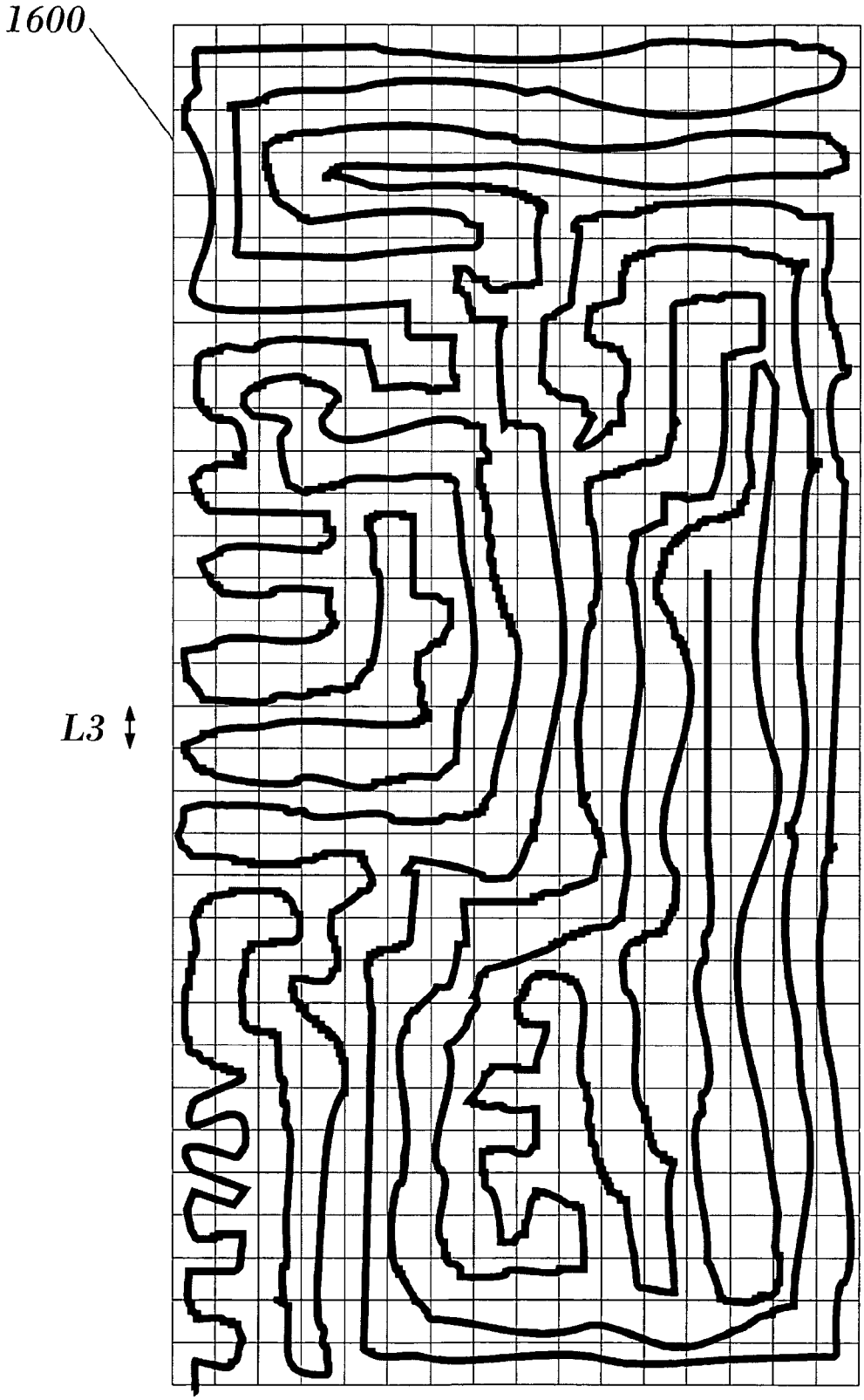

FIG. 16—The curve of FIG. 13 in a 512-cell grid, wherein the curve crosses at least one point of 509 cells.

Figure 17:
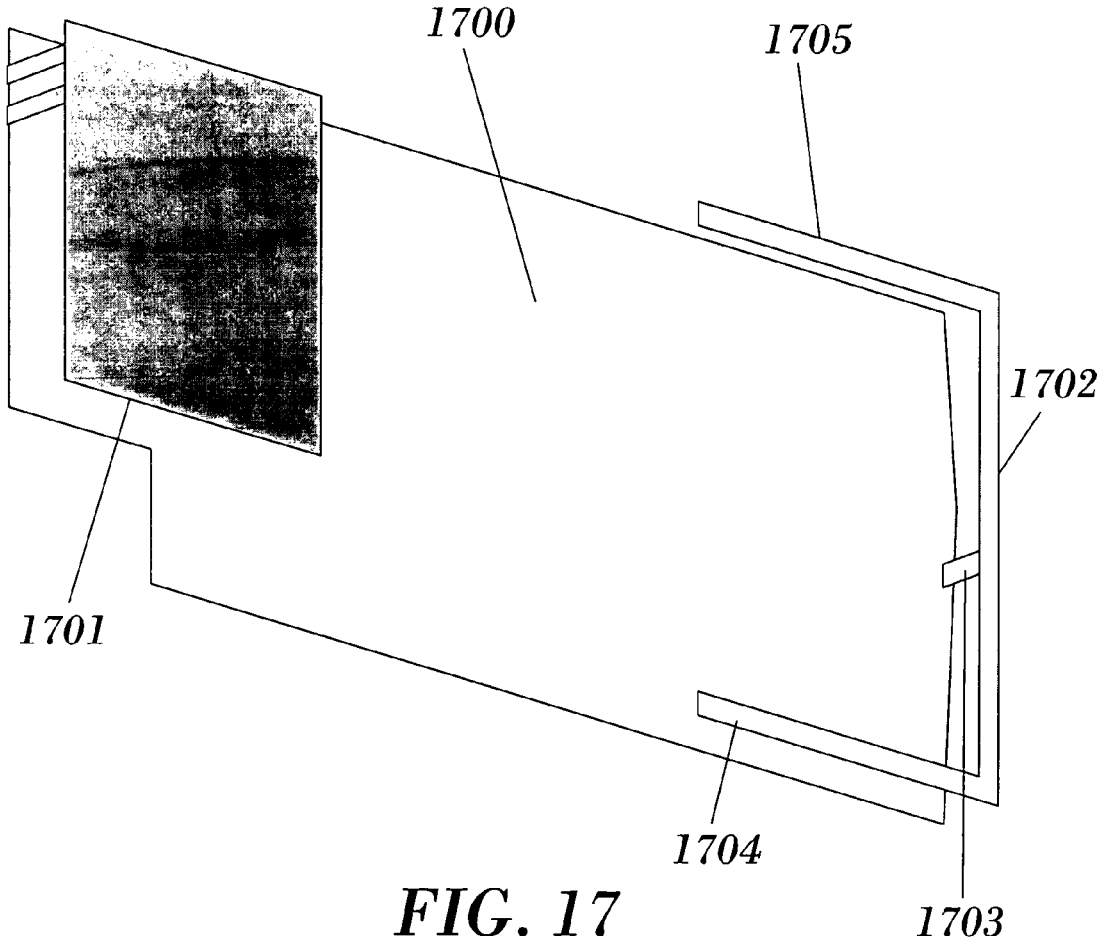

FIG. 17—Perspective view of the PCB of a portable wireless device including a ground plane, to which a conductive element with two branches is coupled.

FIG. 18—Diagrams illustrating how antenna and radiation efficiencies can be improved by using a conductive element according to the invention.

DESCRIPTION OF THE PREFERRED EMBODIMENTS

According to the present invention, in some cases an antenna set according to the invention can be advantageous for a portable wireless device, for example, for the following reasons:

- Integration of multiple bands (and related wireless services) in a portable wireless device, due to the increase in the bandwidth of the antenna set, allowing operation in more communication bands and added-value services (such as high data rate functions, multimedia services, or on-line video) using a single multiband antenna set.
- Longer service life of the battery of a portable wireless device as a consequence of the higher levels of efficiency of the antenna set.
- Integrability of the invention in the portable wireless device, since the design and optimization of the conductive element of the antenna set can be done without interfering with the design of the PCB of the device.

These aspects are particularly interesting for small-sized handsets (such as for instance bar-type, clamshell-type, slider-type or swivel-type handsets), because the reduced dimensions of the ground plane make it difficult for the ground plane to contribute efficiently to the radiation process of the antenna element. The conductive element has the ability to make such small-sized ground planes resonant at relevant frequencies, improving the performance of the antenna set in at least one band of operation, or allowing for further miniaturization of the antenna element.

In order to reduce the dimensions of the conductive element and/or to achieve multi-frequency operation, the said conductive element can advantageously include at least one portion shaped as a space-filling curve, a box-counting curve, or a grid dimension curve, and/or comprise a multilevel structure.

The present invention can be applied to antennas with different antenna topologies. In particular, the antenna element could be selected from the group of topologies comprising monopoles, folded and loaded monopoles, or their slot or aperture equivalents (slot monopoles, folded and loaded slot monopoles). Other structures include shorted and bent monopoles (L-shaped monopoles, inverted-F antennas or IFA), multibranch structures, coupled monopoles and again their aperture equivalents. Other possible antenna configurations are microstrip or patch antennas, including their shorted versions (shorted patches and planar inverted-F or PIFA structures), or antennas that combine elements of different antenna topologies, such as for instance a slot with a PIFA or IFA (structure also referred to as FracSiot). Furthermore, the antennas might comprise one or several parasitic elements in addition to an electrically-driven element (also referred to as active element). All of these antenna elements could be used in a portable wireless device including a ground plane and a conductive element coupled to the ground plane, according to the present invention. In some preferred embodiments of the present invention, at least a portion of the antenna element is shaped as a space-filling curve, or as a box-counting curve, or as a grid dimension curve, or comprises a multilevel structure.

In some preferred embodiments, the portable wireless device comprising the antenna set can be operating at one, two, three, four, five or more of the following communication and connectivity services: GSM (GSM850, GSM900, GSM1800, American GSM or PCS1900, GSM450), UMTS, WCDMA, CDMA, Bluetooth™ IEEE802.11a, IEEE802.11b, IEEE802.11g, WLAN, WiFi, UWB, ZigBe.

Space Filling Curves

In some examples, at least one part of the antenna set (such as for instance the antenna element, the ground plane, or the conductive element of the invention that is coupled to the ground plane) may be miniaturized by shaping at least a portion of the conducting trace, conducting wire or contour of a conducting sheet of the said at least one part of the antenna set (e.g., a part of the arms of a dipole, the perimeter of the patch of a patch antenna, the slot in a slot antenna, the loop perimeter in a loop antenna, or other portions of the antenna, and/or a portion of the conductive element and/or of the ground plane), as a space-filling curve (SFC).

An SFC is a curve that is large in terms of physical length but small in terms of the area in which the curve can be included. More precisely, for the purposes of this patent document, an SFC is defined as follows: a curve having at least five segments, or identifiable curve sections, that are connected in such a way that each segment or section forms an angle or bend with any adjacent segments, such that no pair of adjacent segments defines a larger straight segment. In addition, an SFC does not intersect with itself at any point except possibly the initial and final point (that is, the whole curve can be arranged as a closed curve or loop, but none of the lesser parts of the curve form a closed curve or loop). An SFC can comprise straight segments, curved segments, or a combination of both.

A space-filling curve can be fitted over a flat or curved surface, and due to the angles between segments, the physical length of the curve is larger than that of any straight line that can be fitted in the same area (surface) as the space-filling curve. Additionally, to shape the structure of a part of an antenna set, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments and the narrower the angles between them, the smaller the size of a given part of the antenna set.

Box-Counting Curves

In other examples, at least one part of the antenna set may be miniaturized by shaping at least a portion of the conducting trace, conducting wire or contour of a conducting sheet of the said at least one part of the antenna set to have a selected box-counting dimension.

For a given geometry lying on a surface, the box-counting dimension is computed as follows. First, a grid with substantially squared identical cells boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conducting trace, conducting wire or contour of a conducting sheet of a part of an antenna set and applying the above algorithm. The first grid should be chosen such that the rectangular area is meshed in an array of at least 5×5 boxes or cells, and the second grid should be chosen such that L2=½ L and such that the second grid includes at least 10×10 boxes. The minimum rectangular area is an area in which there is not an entire row or column on the perimeter of the grid that does not contain any piece of the curve. Further, the minimum rectangular area preferably refers to the smallest possible rectangular area that completely encloses the curve.

The desired box-counting dimension for the curve may be selected to achieve a desired amount of miniaturization. The box-counting dimension should be larger than 1.1 in order to achieve some size reduction of a part of an antenna set. If a larger degree of miniaturization is desired, then a larger box-counting dimension may be selected, such as a box-counting dimension ranging from 1.5 to 3. For the purposes of this patent document, curves in which at least a portion of the geometry of the curve, or the entire curve, has a box-counting dimension larger than 1.1 are referred to as box-counting curves.

For very small parts of an antenna set, for example parts of an antenna set that fit within a rectangle having maximum size equal to one-twentieth the longest free-space operating wavelength of the antenna set, the box-counting dimension may be computed using a finer grid. In such a case, the first grid may include a mesh of 10×10 equal cells, and the second grid may include a mesh of 20×20 equal cells. The box-counting dimension (D) may then be calculated using the above equation.

In general, for a given resonant frequency of an antenna set, the larger the box-counting dimension of a part of the antenna set, the higher the degree of miniaturization that will be achieved by the said part of the antenna set. One way to enhance the miniaturization capabilities of a part of the antenna set is to arrange the several segments of the curve of the pattern of said part of the antenna set in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

FIG. 12 illustrates an example of how the box-counting dimension of a curve (1200) is calculated. The example curve (1200) is placed under a 5×5 grid (1201) (FIG. 12 upper part) and under a 10×10 grid (1202) (FIG. 12 lower part). As illustrated, the curve (1200) touches N1=25 boxes in the 5×5 grid (1201) and touches N2=78 boxes in the 10×10 grid (1202). In this case, the size of the boxes in the 5×5 grid (1201) is twice the size of the boxes in the 10×10 grid (1202). By applying the above equation, the box-counting dimension of the example curve (1200) may be calculated as D=1.6415. In addition, further miniaturization is achieved in this example because the curve (1200) crosses more than 14 of the 25 boxes in grid (1201), and also crosses at least one box twice, that is, at least one box contains two non-adjacent segments of the curve. More specifically, the curve (1200) in the illustrated example crosses twice in 13 boxes out of the 25 boxes.

Grid Dimension Curves

In further examples, at least one part of the antenna set may be miniaturized by shaping at least a portion of the conducting trace, conducting wire or contour of a conducting sheet of the said at least one part of the antenna set to include a grid dimension curve 1300.

For a given geometry lying on a planar or curved surface, the grid dimension of curve may be calculated as follows. First, a grid 1400 with substantially identical cells of size L1 is placed over the geometry of the curve, such that the grid completely covers the geometry, and the number of cells N1 that include at least a point of the geometry are counted. Second, a grid 1500 with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve. Further the minimum rectangular area preferably refers to the smallest possible rectangular area that completely encloses the curve.

The first grid may, for example, be chosen such that the rectangular area is meshed in an array of at least 25 substantially equal cells. The second grid may, for example, be chosen such that each cell of the first grid is divided in 4 equal cells, such that the size of the new cells is L2=½ L1, and the second grid includes at least 100 cells.

The desired grid dimension for the curve may be selected to achieve a desired amount of miniaturization. The grid dimension should be larger than 1 in order to achieve some size reduction of a part of the antenna set. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 is referred to as a grid dimension curve.

In general, for a given resonant frequency of the antenna set, the larger the grid dimension of a part of the antenna set, the higher the degree of miniaturization that will be achieved by the said part of the antenna set. One example way of enhancing the miniaturization capabilities of a part of an antenna set is to arrange the several segments of the curve of the pattern of said part of the antenna set in such a way that the curve intersects at least one point of at least 50% of the cells of the first grid with at least 25 cells enclosing the curve. In another example, a high degree of miniaturization may be achieved by arranging a part of the antenna set such that the curve crosses at least one of the cells twice within the 25-cell grid, that is, the curve includes two non-adjacent portions inside at least one of the cells or cells of the grid.

An example of a grid-dimension curve 1300 is given in FIG. 13. In FIG. 14 it is shown how this curve of FIG. 13 is placed in a 4×8 grid 1400 with 32 cells. The curve crosses all 32 cells and therefore N1=32. In FIG. 15 the curve of FIG. 13 is shown in combination with an 8×16 grid 1500 with 128 cells. The curve crosses all 128 cells and therefore N2=128. The resulting grid-dimension is therefore 2. In FIG. 16 the curve of FIG. 13 is shown placed in a 16×32 grid 1600 with 512 cells (of size L3). The curve crosses at least one point of 509 cells.

Multilevel Structures

In some examples, at least a portion of the conducting trace, conducting wire or conducting sheet of at least one part of the antenna set may be coupled, either through direct contact or electromagnetic coupling, to a conducting surface, such as a conducting polygonal or multilevel surface. Further the curve of the said at least one part of the antenna set may include the shape of a multilevel structure. A multilevel structure is formed by gathering several geometrical elements, such as polygons or polyhedrons, of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling electromagnetically at least some of such geometrical elements to one or more other elements, whether by proximity or by direct contact between elements.

At least two of the elements may have a different size. However, also all elements may have the same or approximately the same size. The size of elements of different a type may be compared by comparing their largest diameter.

The majority of the component elements of a multilevel structure have more than 50% of their perimeter (for polygon and surface like elements) or their surface (for polyhedrons) not in contact with any of the other elements of the structure. Thus, the component elements of a multilevel structure may typically be identified and distinguished, presenting at least two levels of detail: that of the overall structure and that of the polygon or polyhedron elements that form it. Additionally, several multilevel structures may be grouped and coupled electromagnetically to each other to form higher-level structures. In a single multilevel structure, all of the component elements are polygons with the same number of sides or are polyhedrons with the same number of faces. However, this characteristic is not present when several multilevel structures of different natures are grouped and electromagnetically coupled to form meta-structures of a higher level.

A multilevel part of an antenna set includes at least two levels of detail in the body of the said part of the antenna set: that of the overall structure and that of the majority of the elements (polygons or polyhedrons) which make it up. This may be achieved by ensuring that the area of contact or intersection (if it exists) between the majority of the elements forming the said part of antenna set is only a fraction of the perimeter or surrounding area of said polygons or polyhedrons.

One example property of multilevel antenna sets is that the radioelectric behavior of the antenna can be similar in more than one frequency band. Antenna input parameters (e.g., impedance) and radiation pattern remain similar for several frequency bands (i.e., the antenna set has the same level of adaptation or standing wave relationship in each different band), and often the antenna set presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, a part of an antenna set with multilevel structure may have a smaller than usual size when compared to other antenna sets in which the said part has a simpler structure (such as those consisting of a single polygon or polyhedron). Additionally, the edge-rich and discontinuity-rich structure of a multilevel antenna set may enhance the radiation process, relatively increasing the radiation resistance of the antenna element and reducing the quality factor Q (i.e., increasing its bandwidth).

A multilevel antenna element may be used in many antenna configurations, such as dipoles, monopoles, patch or microstrip antennae, coplanar antennae, reflector antennae, aperture antennae, antenna arrays, or other antenna-configurations. In addition, multilevel structures for parts of an antenna set may be formed using many manufacturing techniques, such as printing on a dielectric substrate by photolithography (printed circuit technique); dieing on metal plate, repulsion on dielectric, or others.

FIG. 1 shows three embodiments of an antenna set for a portable wireless device according to an embodiment of the present invention. The figure represents a perspective view of the PCB (100) of the device in which there is contained a ground plane constituted by a conductive layer of the PCB. An antenna element (101) is mounted on the top portion of the PCB (100) (that is, adjacent to one of the shorter ends of the substantially rectangular PCB) and has a feeding contact (102) located substantially close to the top right corner of the PCB (100). In this example, the antenna element (101) also comprises a short contact (103), which is connected to the ground plane of the PCB (100). However, in other embodiments of the present invention, the antenna element (101) will not have a short contact. The antenna set also comprises a conductive element (104) placed near the bottom edge of the PCB. The connection of the conductive element (104) to the ground plane of the PCB (100) is made through a contact (105, 106, 107).

The conductive element (104) can be connected to a landing area or pad on the PCB (100) by any suitable means. The contact (105, 106, 107) can take the form of, for example, a spring contact, or a pogo pin. In some cases such a connection can be achieved by directly soldering the conductive element (104) to the landing area or pad. In turn, said landing area or pad is connected to, or coupled with, the ground plane of the PCB (100).

In some cases the conductive element (104) will be coupled to ground through at least one circuit element selected from the group consisting essentially of inductive elements, capacitive elements, resistive elements, jumpers, or bypasses. The circuit element can be advantageously used, in conjunction with the conductive element (104), to tune the electrical length of the ground plane of the PCB (100) (in combination with the conductive element) in order to enhance the frequency response of the antenna set in, at least, one operating frequency band. The contacts (105, 106, 107) are only schematically illustrated in FIG. 1, and can be constituted by any of the contact or circuit elements mentioned above, or by suitable equivalents or alternatives.

In FIG. 1*a*, the conductive element (104) is connected to the ground plane of the PCB, via the contact (105) (e.g., a spring contact, or a pogo pin), near the left bottom corner of the PCB (100), which means that the antenna feeding point (102) and the contact (105) are placed substantially close to opposite corners of the PCB (100) (such as, for example, the upper right corner and the lower left corner of a substantially rectangular PCB). Such an embodiment can be advantageous because it tends to maximize the path followed by the currents flowing on the PCB (100) from the antenna element (101) towards the conductive element (104). Furthermore, in this embodiment, the contact (105) is located on one end of the conductive element (104) (namely, on its left-hand side).

Alternatively, in FIG. 1*c*, the conductive element to the (104) is connected to the ground plane of the PCB (100) by means of the contact (107) located near the right bottom corner of the PCB (100). This means that in this particular case, the feeding point (102) and the contact (107) are in adjacent corners of the PCB (100) (that is, in this case, in corners corresponding to the same longer side of the substantially rectangular PCB). In this embodiment, as it happened with the one depicted in FIG. 1*a*, the contact (107) is located on one end of the conductive element (104) (namely, on its right-hand side).

In the example of FIG. 1*b*, the conductive element (104) is connected to the ground plane of the PCB (100) by means of the contact (106). As in the case of FIGS. 1*a* and 1*c*, the contact (106) is substantially close to the bottom edge of the PCB (100) but, conversely to the other two cases, the contact (106) is not near a corner of the PCB (100). Moreover, the contact (106) is placed near the central part of the conductive element (104), and not close to any of its two ends.

In some embodiments (for instance those in FIG. 1) the conductive element (104) has a length that is less than approximately a quarter of the wavelength for at least one frequency of operation of the antenna set. This can be useful for preventing the conductive element from acting as a parasitic element at said frequency.

FIG. 2*a* illustrates another embodiment of an antenna set comprising a ground plane and conductive element combination according to the present invention. In this case, and without any limitation, the antenna element (201) is a planar inverted-F antenna, or PIFA. The antenna element (201) is located on the top portion of the PCB (200). The antenna set also comprises a conductive element (202) connected to the ground plane of the PCB (200) by means of a contact (203) and optionally through at least one circuit element (that could form part of said contact). In this case, differently from the examples in FIG. 1, the conductive element (202) is embodied as an elongated strip of conductive material, rather than as a plate.

By adjusting the length of the conductive element (202) and selecting the appropriate circuit elements, the ground plane of the PCB (200) can be complemented so that the antenna set can operate simultaneously in several frequency bands with good radioelectric performance (for instance in terms of VSWR, gain, or efficiency), and/or so that an increased bandwidth is obtained in one or more operating bands of the antenna. For illustrative purposes only, the antenna set presented in FIG. 2*a* might exhibit a pentaband behavior, accomodating the GSM bands (850 MHz, 900 MHz, 1800 MHz and 1900 MHz) and UMTS (i.e., it would be a 2G+3G antenna set).

FIG. 2*b* shows another example of the antenna set, in which the conductive element (232) has an elongated shape. The conductive element (232) is coupled to the ground plane of the PCB (200) by means of a contact (233), which in this particular embodiment is located substantially close to the bottom right corner of the PCB (200). In this particular example, the antenna element (201) has its feeding contact and short contact located substantially close to the top left corner of the PCB (200).

A further example of a conductive element with elongated shape is presented in FIG. 2*c*. In this case, a conductive element (262) is placed near the bottom edge of the PCB (200). In this example, the conductive element (262) is coupled to the ground plane of the PCB (200) through a contact (263). The contact (263) is not near any edge of the PCB (200), however, it is closer to the bottom edge of the PCB (200) than to the top edge of the PCB (200), where the antenna element (201) is located.

The choice of the position or positions where the conductive element is coupled to the ground plane can depend on several issues, such as on the space available on the PCB and/or within the wireless device, and also on the extent to which the conductive element should act as a parasitic element with respect to the antenna, and/or as a means for increasing the effective length of the ground plane. The person skilled in the art, when implementing the invention on a specific device, will chose the position of coupling accordingly.

In some embodiments, the electrical length of the conductive element with elongated shape will be approximately equal to, or larger than, a quarter of the wavelength for at least one frequency of operation of the antenna set, while in some other embodiments the electrical length of the conductive element with elongated shape will be less than a quarter of the wavelength for at least a frequency of operation of the antenna set. When shorter than a quarter of the wavelength, the conductive element is not independently tuned to work as a second radiating source at the corresponding frequency (since it will not be resonating at said frequency), but to operate in conjunction with the ground-plane to enhance the radiation of the whole set, by extending the effective electrical length of the ground plane of the PCB.

In certain examples, the conductive element can be fabricated as a plate or sheet of metal (such as for example copper, aluminum, brass, silver, gold, or some other type of good conducting alloy) with a shape and dimensions selected to tune the ground plane of the PCB in at least one particular frequency band. In other cases, said conductive element will be embodied for instance as a flexible or semi-flexible conductive wire or printed circuit board.

FIG. 3 illustrates some embodiments in which the conductive element is formed as a combination of elongated portions and plates. The embodiments correspond to a portable wireless device including a PCB (300) on which an antenna element (301) has been mounted. The ground plane of the PCB (300) is connected to a conductive element (302, 352) arranged to modify the frequency response of the ground plane of the PCB (300). The conductive element (302, 352) comprises a first portion (303, 353) that has an elongated shape, and a second portion (304, 354) that is like a plate, which in some cases can include geometrical elements (such as for example polygons, cf. as in FIG. 3*b*). Although in these examples the conductive element comprises a first elongated portion followed by a plate-like portion, in general said conductive element can comprise a combination of several elongated portions and/or plate-like portions, arranged in any order. Moreover, the structure of the conductive element (302, 352) can comprise segments or edges that are straight, curved, or a combination thereof.

The embodiments in FIGS. 1 and 3 disclose configurations in which the conductive element used to complement the ground plane (104, 302, 352) is a substantially planar structure, with the exception maybe of the region of contact of said conductive element with the PCB. In some other cases, the structure of the conductive element will be conformed to match the shape, or contour, of the enclosure of the portable wireless device in which the antenna set is integrated (for example, but not limited to, the backcover of a mobile phone). Yet in some further embodiments, the conductive element will have a three-dimensional structure, such as the one illustrated in FIG. 4. FIG. 4 discloses an arrangement in which the conductive element (402) used to complement the ground plane of the PCB (400) comprises a first planar portion (403) oriented substantially orthogonally to the PCB of a portable wireless device, and two other planar portions (404) and (405) connected to the said first portion (403) on its right and left end, respectively. The portions (404) and (405) are arranged substantially parallel to the PCB (400), so that the overall conductive element (402) is a volumetric element or has a three-dimensional structure.

The conductive element (402) is connected to a landing area or pad on the PCB (400) by means of the contact (406). In this particular embodiment, the ground plane of the PCB (400) can be tuned to resonate at a particular frequency band by selecting the dimensions of the conductive element (402) and the circuit element that is used to connect the conducting element (402) to the ground plane of the PCB (400) (such as for instance an inductor, a resistor, a jumper, or a bypass). Moreover, the portions (404) and (405) can be advantageously used to create a capacitive coupling between the conductive element (402) and the ground plane of the PCB (400), adding an extra degree of freedom when tuning the frequency response of the ground plane.

FIG. 5 shows another embodiment of an antenna set for a portable wireless device, in accordance with an embodiment of the invention. Similarly to the embodiment in FIG. 2, the conductive element (502) has an elongated shape of a multi-section curve. However, while the conductive element (202) of FIG. 2 is arranged as a three-dimensional structure, the conductive element (502) of FIG. 5 is folded in such a way that all the segments that compose it lie in one single plane. Such an embodiment can be preferred because it makes it possible to fabricate the conductive element (502) directly by means of a process involving the steps of stamping a metal sheet or plate, avoiding any subsequent folding of portions of the conductive element to create a three-dimensional structure. Alternatively, the conductive element (502) could be fabricated as a printed trace of conductive material on a dielectric substrate (such as for example fiber-glass, Teflonbased substrates such as Cuclad®, or other standard radiofrequency and microwave substrates such as Adon®, Rogers® or Kapton®) or in a flexfilm.

In some embodiments, the conductive element (104, 202, 302, 352, 402, 502) will be preferably placed substantially close to the perimeter of the ground plane of the PCB (100, 200, 300, 400, 500). On the other hand, the conductive element can be arranged to avoid components and/or modules that are typically in the periphery of PCB (such as for example, but not limited to, a battery connector, a headset plug, or a bus connector).

In FIG. 6 there are some examples of a portable wireless device in which the conductive element is not necessarily placed on the same surface of the PCB as the antenna element. FIG. 6 depicts a side-view of a multilayer PCB (600) of a portable wireless device. A layer of said PCB (600) is used as the ground plane (603) of the antenna set of said wireless device, said antenna set further comprising an antenna element (601) mounted on the top surface of the PCB (600). In addition, the antenna set comprises a conductive element (602, 632, 662) coupled to the ground plane (603) and used to tune its frequency response. The conductive element (602, 632, 662) is folded to better match the dimensional constraints of the enclosure or cover of the portable wireless device. FIG. 6*a* illustrates a case in which the conductive element (602) lies on the top surface of the PCB (600), that is, on the same side as the antenna element (601). Such an arrangement was also represented in FIGS. 1 through 5. In the case of FIG. 6*b*, the conductive element (632) is placed on the bottom surface of the PCB, that is, on the opposite side of the PCB with respect to the antenna element (601). Finally, FIG. 6*c* corresponds to the case in which the conductive element (662) has been shaped in such a way that a part of its structure is above the top surface of the PCB, on the same side of the PCB as the antenna element (601), and another part of its structure is below the bottom surface of the PCB, on the opposite side of the PCB with respect to the antenna element (601). The conductive element can be arranged to cross from one side to the other of the PCB either outside of the PCB or through a hole, aperture or notch in the PCB.

One common feature of the embodiments disclosed in FIGS. 1 through 6 is that the conductive element used to tune the frequency response of the ground plane (and, thus, of the entire antenna set) is not embedded in the PCB of the portable wireless device that carries the antenna set and does not form part of said PCB as such. On the other hand, FIG. 7 presents a portable wireless device in which a conductive element (702) is connected to the ground plane of the PCB (700) by means of a contact (703). The contact (703) can comprise a circuit element to have greater flexibility when tuning the frequency response of the ground plane of the PCB (700). One aspect of the conductive element (702) is that it is coplanar or substantially coplanar to the ground plane of the PCB (700). In some embodiments, the conductive element (702) can be included in a multilayer PCB as a printed pattern in a conductive layer of said multilayer PCB.

In some embodiments, the conductive element can comprise more than one contact region to connect (either directly, or through a circuit element) the conductive element to the ground plane of the PCB of a portable wireless device. FIG. 8*a* depicts a portable wireless device including a PCB (800), an antenna element (801) and a conductive element (802) that is used to tune the frequency response of the ground plane contained in the PCB (800). In this example, the conductive element (802) is coupled to the ground plane of the PCB (800) by means of three contacts (803, 804, 805).

FIG. 8*c* discloses an embodiment comprising more than one conductive element that can be used to tune the frequency response of the ground plane of the PCB (800) and enhance the radiation process of the antenna set. The example shows three conductive elements (862, 863, 864) connected or coupled to the ground plane of the PCB (800). The use of multiple conductive elements can be advantageous to tune the frequency behavior of the ground plane in different frequency bands with or without overlapping. In this case, the conductive elements (862, 863, 864) would have different dimensions and each one would be associated with a particular frequency band. As an alternative, it might be interesting in certain applications to broaden the frequency response of the antenna set in a particular frequency band. In these cases, several conductive elements with slightly different dimensions would allow to tune the ground plane in a particular frequency band with broadband behavior.

In that sense, FIG. 17 discloses an example of a portable wireless device comprising a conductive element (1702) used to enhance the frequency response of the ground plane of a PCB (1700). The conductive element (1702) features two branches (1704) and (1705), which can have different lengths. The conductive element (1702) is arranged in the bottom portion of the PCB (1700), near the periphery of the PCB (1700). The portable wireless device further comprises an antenna element (1701) placed on the top portion of the PCB (1700). In this example, said conductive element (1.702) is coupled to the ground plane of the PCB (1700) through a contact (1703) located substantially close to the bottom edge of the PCB (1700). The two branches of the conducting element (1704, 1705) might be advantageous to enhance the radioelectric performance of the antenna set in multiple frequency bands or in a single band but with broadband-behavior.

FIG. 8*b* presents an example in which an elongated conductive element (832) comprises more than one contact region. Contacts (833) and (834) connect or couple the conductive element (832) to the ground plane of the PCB (800).

In some cases both contacts (833) and (834) might be simultaneously connected or coupled to the ground plane of the PCB (800) in order to tune said ground plane with a multi-frequency or broadband behavior. However, in other cases it might be preferable to connect or couple only one contact (833, 834) at a time, so that the antenna set designer, or the portable wireless device manufacturer, can tune the ground plane in a particular frequency band or another using the same conductive element. Such an embodiment of the present invention would allow using a standard conductive element to enhance the radioelectric properties of a portable wireless device in different bands depending, for example, on the different spectrum allocations for wireless terminals in different geographical domains.

In some embodiments, the contact region of the conductive element with the landing area or pad on the PCB of the portable wireless device will preferably occur within a distance from the bottom edge of the PCB (in those embodiments in which the antenna element is placed on the top portion of the PCB) less than a maximum distance. Possible maximum distances include, for example, 5%, 10%, 15%, 20%, 25%, 30%, 35%, 40%, or 50% of the longest dimension of the PCB. In some other examples, the conductive element can be arranged within the portable wireless device in such a way that the contact region of the said element with the landing area or pad on the PCB is closer to the top edge of the PCB than to the bottom edge (again assuming, without loss of generality, that the antenna element is placed on the top portion of the PCB).

FIG. 9 discloses some more examples of a portable wireless device including an antenna set that comprises a conductive element arranged to tune and enhance the radioelectric behavior of the ground plane of the antenna set. In the figure, the PCB (900) carries an antenna element (901), located in the top portion of the PCB (900), and a conductive element (902, 952) connected or coupled to the ground plane of the PCB (900). In FIG. 9*a*, the conductive element (902) is placed above the top surface of the PCB (900), on the same side as the antenna element (901). The orthogonal projection of the conducting element (902) on the plane defined by the PCB (900) is such that the said projection covers a substantial portion of the ground plane of the PCB (900). In this example, the contact region of the conductive element (902) with the corresponding landing area on the PCB (900) does not occur near the bottom edge of the PCB (900). Again, the shape and dimensions of the conductive element (902) can be selected to tune the frequency response of the ground plane of the PCB (900), enhancing the performance of the antenna set in a particular frequency band. For example, in FIG. 9*a*, the conductive element (902) is provided with slots (903, 904) to increase the effective electrical length of the conductive element, that is, the path followed by the currents induced in said conductive element.

FIG. 9*b* discloses a case in which the conductive element (952) is placed below the bottom surface of the PCB. The orthogonal projection of the conductive element (952) on the plane of the PCB (900) overlaps a substantial portion of the ground plane of the PCB (900).

An embodiment like the one in FIG. 9*a* can be particularly interesting as portable wireless devices usually carry a battery that is located on the same side of the PCB as the antenna element. A conductive element (902) as, for example, illustrated in FIG. 9*a* can then be arranged so that the battery is partially or totally sandwiched between the plane of the PCB (900) and the plane of the conductive element (902). In some cases, such as for instance in the embodiment of FIG. 9*a*, the pattern of the conductive element (902) could be created with conductive paint printed or sprayed on the inner side of the cover of the portable wireless device, or as a piece of metal foil that lines the inner side of the plastic enclosure, cover or chassis of said device.

In some embodiments, the maximum height of the conductive element with respect to the plane of the PCB will be preferably less than or approximately equal to a maximum height selected from the group of maximum heights including 2 mm, 4 mm, 6 mm, 8 mm, 10 mm, 15 mm, 20 mm and 25 mm.

FIG. 10 illustrates another embodiment of a portable wireless device in which the chassis of the battery (1002) of the device is used as the conductive element. FIG. 11 presents, for illustration purposes only and without any limitation, a possible way to couple the chassis of the battery (1100) to the RF ground plane of the portable wireless device (1101). In general, the chassis of the battery (1002, 1100) has no electrical functionality at RF frequencies. According to the present invention, the chassis of the battery (1002, 1100) can be advantageously used to enhance the radiation performance of the antenna set in the portable wireless device of FIG. 10. The ground pin of the battery (GND) is connected to the RF ground plane (1101) by means of the tuning circuit (1103). The tuning circuit (1103) comprises one or more circuit elements, which in conjunction with the metal chassis of the battery (1100), can tune the frequency response of the RF ground plane (1101) of the portable wireless device to make it resonant in a particular frequency band. This can be done as the tuning circuit (for example, an inductive element) can be used to modify the effective electrical length of the combination of the ground plane and the conductive element, for example, by modifying the inductance of the coupling between the ground plane and the conductive element. Optionally, the portable wireless device can comprise a DC ground plane (1102) electrically separated from the RF ground plane (1101). In FIG. 11, a DC decoupling circuit (1104) (such as, for example, a series capacitor) and an RF choking circuit (1105) (such as, for example, a series inductor) are advantageously used to allow coupling the chassis of the battery (1100) to the RF ground plane (1101) at RF frequencies without mixing the RF ground plane (1101) and DC ground plane (1102) at lower frequencies (e.g., base-band). In other embodiments, there will be no separation between the RF ground plane (1101) and the DC ground plane (1102), thus making the use of circuits (1104) and (1105) unnecessary.

Experiments have been made with an antenna set comprising a rectangular PCB with a ground plane layer, and with an antenna element arranged at one end of the PCB, and a conductive element in accordance with the invention arranged at the opposite end. The antenna element comprised a two-branch metal plate designed to produce one operating band in the GSM 850-GSM 900 range, and another operating band in the GSM 1800-GSM 1900 range. The arrangement of the antenna element, ground plane and conductive element was substantially in line with FIG. 2*a*.

Figure 18B:
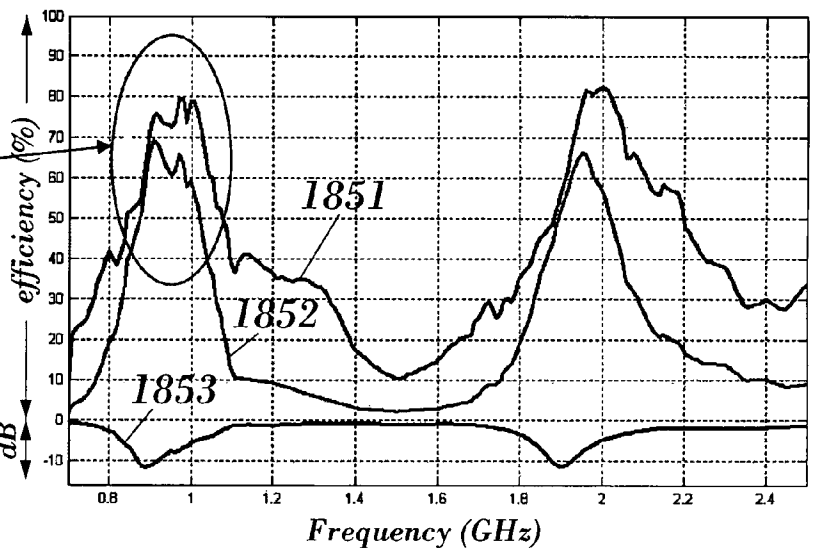
Figure 18A:
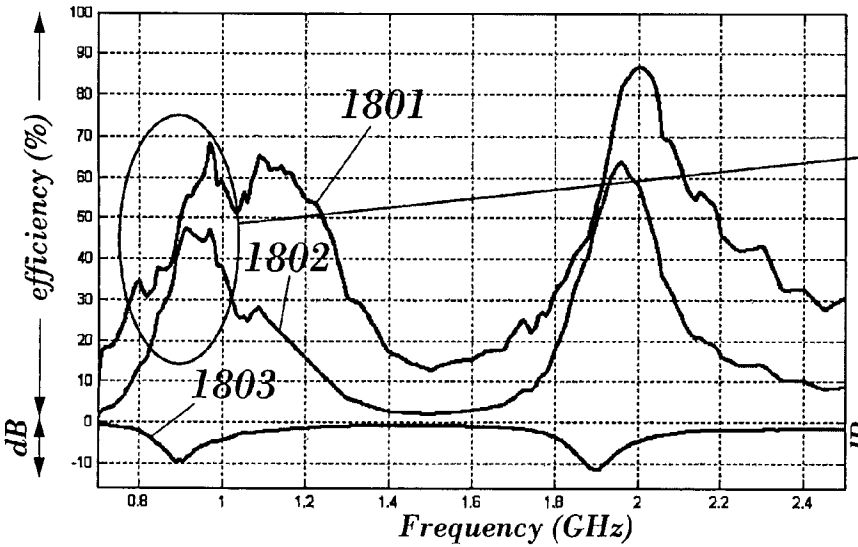

FIGS. 18*a* and 18*b* schematically illustrate radiation efficiency (1801, 1851), antenna efficiency (1802, 1852) and return loss (1803, 1853) for the antenna set without the conductive element (FIG. 18*a*) and with the conductive element (FIG. 18*b*), respectively (the only difference between the two antenna sets subjected to the measurements resides in the presence/absence of the conductive element substantially corresponding to element 202 in FIG. 2*a*). It can be observed how an increased radiation efficiency (cf. curve 1851 with regard to curve 1801) and antenna efficiency (cf. curve 1852 with regard to curve 1802) was obtained in several frequency ranges, when the antenna set included the conductive element. Comparing the return loss curve with (1853) and without (1803) the conductive element, it can be observed how the −6 dB operating band in the GSM850-GSM900 range is increased. This can be useful for better accommodating the corresponding GSM 850 and GSM 900 services.

Table 1 illustrates relevant values corresponding to a comparison of the antenna set with and without the radiation enhancing conductive element:

TABLE 1

| | Antenna efficiency (%) | | |
|---|---|---|---|
| Frequency (MHz) | Without conductive element | With conductive element | Difference (dB) |
| 820 | 16.2 | 23.5 | 1.62 |
| 850 | 27.1 | 41.2 | 1.82 |
| 880 | 33.8 | 51.6 | 1.84 |
| 890 | 40.7 | 62.2 | 1.84 |
| 920 | 46.7 | 67.4 | 1.59 |
| 960 | 44.4 | 62.0 | 1.45 |

Thus, it can be observed how, by using the conductive element, the antenna efficiency was improved by approximately 1.5 dB or more all throughout the GSM 850-GSM 900 band. Thus, in this way, the conductive strip could be used to increase, for example, the bandwidth of the operating band in the corresponding frequency range, for better accommodating the GSM 850 and GSM 900 services.

Similar good results have been found when implementing the invention in a real platform, involving LCD, keypad and EMC shielding.

Obviously, the present invention can be implemented in many different ways, and the specific way of implementation of the conductive element will obviously depend on the desired characteristics of the other elements involved, such as the PCB (and the ground plane of the PCB) and the antenna element, as well as on the specific frequency ranges in which an enhancement of radiation parameters is desired, as well as on the extent to which said parameters need to be enhanced. In many cases, some empirical or "trial-and-error" based approaches may be necessary. However, nowadays, such trial-and-error approaches are substantially facilitated by many commercially available software applications for estimating antenna performance. The skilled person will, based on the teachings of the present document, be able to easily enhance relative parameters by using one or more conductive elements in accordance with the invention and adapting their shape and position in accordance with the criteria applicable to each specific case.

The invention claimed is:

1. A portable wireless device comprising an antenna set, the antenna set comprising:

at least one antenna element;

a ground plane;

a conductive element, the conductive element being different from the at least one antenna element and is adapted to enhance a radioelectric performance of the antenna set in at least one operating band of the antenna set;

wherein the ground plane comprises a first edge and a second edge, the first edge and the second edge being the two farthest apart opposite edges of the ground plane;

wherein the at least one antenna element is arranged within the antenna set substantially near the first edge of the ground plane;

wherein the conductive element comprises at least one contact to couple the conductive element to the ground plane, wherein the at least one contact being located closer to the second edge of the ground plane than to the first edge of the ground plane; and wherein the conductive element comprises a combination of at least one elongated portion and at least one plate-like portion.

2. The portable wireless device according to claim 1, wherein the ground plane comprises a conductive layer of a printed circuit board.

3. The portable wireless device according to claim 1, wherein the conductive element extends above and/or below the ground plane such that the conductive element has an orthogonal projection on the ground plane.

4. The portable wireless device according to claim 3, wherein the orthogonal projection of the conductive element on the ground plane extends over an area corresponding to at least 25% of an area of the ground plane.

5. The portable wireless device according to claim 3, wherein the orthogonal projection of the conductive element on the ground plane extends over an area corresponding to less than 5% of an area of the ground plane.

6. The portable wireless device according to claim 3, wherein the orthogonal projection of the conductive element on the ground plane extends over an area corresponding to less than 10% of an area of one side of the conductive element.

7. The portable wireless device according to claim 1, wherein the conductive element extends in a direction substantially parallel to the ground plane.

8. The portable wireless device according to claim 1, wherein the conductive element has a tri-dimensional configuration, whereby at least one part of the conductive element is arranged in one plane and another part of the conductive element in another plane.

9. The portable wireless device according to claim 1, wherein the at least one antenna element comprises at least one of a feeding contact and a short contact located at a distance from the first edge of the ground plane smaller than 10% of a distance between the first edge and the second edge.

10. The portable wireless device according to claim 1, wherein the conductive element comprises at least one multilevel structure.

11. A portable wireless device comprising an antenna set, the antenna set comprising:

at least one antenna element;

a ground plane which is integral to a printed circuit board and comprises a conductive layer of the printed circuit board;

a conductive element, the conductive element being different from the at least one antenna element and is adapted to enhance a radioelectric performance of the antenna set in at least one operating band of the antenna set and is not an integral part of the printed circuit board;

wherein the ground plane includes a first edge and a second edge, the first edge and the second edge being the two farthest apart opposite edges of the ground plane;

wherein the at least one antenna element is mounted on the printed circuit board substantially near the first edge;

wherein an orthogonal projection of the conductive element on the ground plane is such that there is an overlap region with the ground plane;

wherein the conductive element comprises a first portion closer to the first edge than to the second edge, and a second portion closer to the second edge than to the first edge; and wherein the conductive element further comprises at least one contact adapted to couple the conductive element to the ground plane of the printed circuit board, wherein the at least one contact being located within the first portion of the conductive element.

12. The portable wireless device according to claim 11, wherein the conductive element is provided with slots to increase an electric path along the conductive element.

13. The portable wireless device according to claim 11, wherein the at least one antenna element comprises a feeding contact and/or a short contact located at a distance from the first edge of the ground plane smaller than 10% of a distance between the first edge and the second edge.

14. The portable wireless device according to claim 11, wherein the conductive element comprises at least one multilevel structure.

15. The portable wireless device according to claim 11, wherein the conductive element comprises a chassis of a battery of the portable wireless device.

16. The portable wireless device according to claim 11, wherein the conductive element extends above and/or below the ground plane such that the conductive element has an orthogonal projection on the ground plane, said orthogonal projection extending over an area corresponding to at least 25% of an area of the ground plane.

17. A portable wireless device comprising an antenna set, the antenna set comprising:

at least one antenna element;

a ground plane;

a conductive element, the conductive element being different from the at least one antenna element and is adapted to enhance a radioelectric performance of the antenna set in at least one operating band of the antenna set;

wherein the ground plane comprises a first edge and a second edge, the first edge and the second edge being the two farthest apart opposite edges of the ground plane;

wherein the at least one antenna element is arranged within the antenna set substantially near the first edge of the ground plane;

wherein the conductive element comprises at least one contact to couple the conductive element to the ground plane, wherein the at least one contact being located closer to the second edge of the ground plane than to the first edge of the ground plane; and wherein the conductive element is coupled to the ground plane through at least one circuit element, the at least one circuit element comprising at least one of: an inductive element, a capacitive element, a resistive element, a jumper, and a bypass.

18. The portable wireless device according to claim 17, wherein the at least one antenna element comprises a feeding contact and/or a short contact located substantially close to an end of the first edge of the ground plane.

19. The portable wireless device according to claim 17, wherein the conductive element does not extend above or below the ground plane, whereby the conductive element does not have any orthogonal projection on the ground plane.

20. The portable wireless device according to claim 17, wherein the ground plane has a substantially rectangular shape featuring two shorter sides corresponding to the first edge and to the second edge, respectively, and two longer sides, and wherein the antenna set has a feeding point arranged less than a distance X from one of the longer side, and wherein the conductive element is coupled to the ground plane at less than a distance X from the opposite longer side, X being less than 25% of the distance between the longer sides.

21. The portable wireless device according to claim 17, wherein the conductive element comprises a conductive strip comprising a plurality of segments arranged so that the strip is not a straight strip.

22. The portable wireless device according to claim 17, wherein the conductive element extends in a direction substantially perpendicular to the ground plane.

23. The portable wireless device according to claim 17, wherein the conductive element comprises a conductive coating on an element of the portable wireless device.

24. The portable wireless device according to claim 23, wherein the element comprises at least one of:

an enclosure;

a cover; and a chassis of the portable wireless device.

25. The portable wireless device according to claim 23, wherein the conductive coating comprises a conductive paint.

26. The portable wireless device according to claim 23, wherein the conductive coating comprises a metal foil.

27. A portable wireless device comprising an antenna set, the antenna set comprising:

at least one antenna element;

a ground plane;

a conductive element, the conductive element being different from the at least one antenna element and is adapted to enhance a radioelectric performance of the antenna set in at least one operating band of the antenna set;

wherein the ground plane comprises a first edge and a second edge, the first edge and the second edge being the two farthest apart opposite edges of the ground plane;

wherein the at least one antenna element is arranged within the antenna set substantially near the first edge of the ground plane;

wherein the conductive element comprises at least one contact to couple the conductive element to the ground plane, wherein the at least one contact being located closer to the second edge of the ground plane than to the first edge of the ground plane;

wherein at least one portion of the conductive element is shaped as a curve having at least five segments that are connected in such a way that each segment forms an angle with any adjacent segment, such that no pair of adjacent segments defines a larger straight segment;

wherein the curve does not intersect with itself at any point except, optionally, at the initial and final point of the curve; and wherein the at least five segments of the curve are shorter than one fifth of a longest free-space operating wavelength.

28. The portable wireless device according to claim 27, wherein the at least five segments are shorter that one tenth of the longest free-space operating wavelength.

29. The portable wireless device according to claim 27, wherein the at least one antenna element comprises at least one of a feeding contact and a short contact located at a distance from the first edge of the ground plane smaller than 10% of a distance between the first edge and the second edge.

30. The portable wireless device according to claim 27, wherein the conductive element does not extend above or below the ground plane, whereby the conductive element does not have any orthogonal projection on the ground plane.

31. The portable wireless device according to claim 27, wherein the conductive element extends in a direction substantially perpendicular to the ground plane.

32. The portable wireless device according to claim 27, wherein the conductive element has a tri-dimensional configuration, whereby at least one part of the conductive element is arranged in one plane and another part of the conductive element in another plane.

33. The portable wireless device according to claim 27, wherein said curve defines a box-counting curve featuring a box-counting dimension larger than 1.1.

34. The portable wireless device according to claim 27, wherein said curve defines a grid dimension curve featuring a grid dimension larger than 1.

35. The portable wireless device according to claim 27, wherein said curve defines a substantially non-periodic space-filling curve.

36. A portable wireless device comprising an antenna set, the antenna set comprising:

at least one antenna element;

a ground plane;

a plurality of conductive elements, each conducting element of the plurality of conductive elements being different from the at least one antenna element and is adapted to enhance a radioelectric performance of the antenna set in at least one operating band of the antenna set;

wherein the ground plane comprises a first edge and a second edge, the first edge and the second edge being the two farthest apart opposite edges of the ground plane;

wherein the at least one antenna element is arranged within the antenna set substantially near the first edge of the ground plane;

wherein each conducting element of the plurality of conductive elements comprises at least one contact to couple said conductive element to the ground plane, wherein the at least one contact of a first conducting element of the plurality of conductive elements and the at least one contact of a second conducting element of the plurality of conductive elements being both located closer to the second edge of the ground plane than to the first edge of the ground plane; and wherein the first conductive element and the second conductive element have substantially different dimensions and are arranged to affect different operating bands of the antenna set.

37. The portable wireless device according to claim 36, wherein at least one conductive element of the plurality of conductive elements comprises a conductive strip comprising a plurality of segments arranged so that the strip is not a straight strip.

38. The portable wireless device according to claim 36, wherein at least one conductive element of the plurality of conductive elements comprises a conductive coating on an element of the portable wireless device.

39. A portable wireless device comprising an antenna set, the antenna set comprising:

at least one antenna element;

a printed circuit board, the printed circuit board comprising a ground plane;

a conductive element, the conductive element being different from the at least one antenna element and is adapted to enhance a radioelectric performance of the antenna set in at least one operating band of the antenna set;

wherein the conductive element comprises two branches arranged on a same side of the printed circuit board;

wherein the ground plane comprises a first edge and a second edge, the first edge and the second edge being the two farthest apart opposite edges of the ground plane;

wherein the at least one antenna element is arranged within the antenna set substantially near the first edge of the ground plane; and wherein said conductive element comprises at least one contact to couple said conductive element to the ground plane, wherein the at least one contact being located closer to the second edge of the ground plane than to the first edge of the ground plane.

40. The portable wireless device according to claim 39, wherein the antenna element is arranged on said same side of the printed circuit board as the conductive element.

41. The portable wireless device according to claim 39, wherein at least one of the two branches of the conductive element comprises an elongated strip.

42. A method of enhancing efficiency within at least one operating band of an antenna set, the antenna set comprising:

at least one antenna element; and a ground plane;

wherein the ground plane comprises a first edge and a second edge, the first edge and the second edge being the two farthest apart opposite edges of the ground plane;

the method comprising the steps of:

providing a conductive element to the antenna set, the conductive element being different from the at least one antenna element and is adapted to enhance a radioelectric performance of the antenna set in at least one operating band of the antenna set;

wherein said conductive element comprises at least one contact to couple said conductive element to the ground plane;

arranging the at least one antenna element within the antenna set substantially near the first edge of the ground plane;

arranging said conductive element within the antenna set so that the at least one contact is located closer to the second edge of the ground plane than to the first edge of the ground plane; and providing at least one circuit element to couple the conductive element to the ground plane, the at least one circuit element comprising at least one of: an inductive element, a capacitive element, a resistive element, a jumper, and a bypass.

* * * * *